US011994336B2

(12) United States Patent
Deka et al.

(10) Patent No.: US 11,994,336 B2
(45) Date of Patent: May 28, 2024

(54) VACUUM INSULATED STRUCTURE WITH THERMAL BRIDGE BREAKER WITH HEAT LOOP

(71) Applicant: WHIRLPOOL CORPORATION, Benton Harbor, MI (US)

(72) Inventors: Lakshya J. Deka, Mishawaka, IN (US); Lynne F. Hunter, Dorr, MI (US); Hua Liu, St. Joseph, MI (US); Dustin M. Miller, South Bend, IN (US); Abhay Naik, Stevensville, MI (US); Sanjesh Kumar Pathak, Stevensville, MI (US); Paul B. Allard, Coloma, MI (US); Eric J. Dherde, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 101 days.

(21) Appl. No.: 17/208,082

(22) Filed: Mar. 22, 2021

(65) Prior Publication Data

US 2021/0207878 A1 Jul. 8, 2021

Related U.S. Application Data

(63) Continuation-in-part of application No. 17/037,855, filed on Sep. 30, 2020, now Pat. No. 11,555,643, and (Continued)

(51) Int. Cl.
*F25D 23/08* (2006.01)
*F25D 23/06* (2006.01)

(52) U.S. Cl.
CPC ..... *F25D 23/062* (2013.01); *F25D 23/066* (2013.01); *F25D 2201/14* (2013.01)

(58) Field of Classification Search
CPC .. F25D 23/085; F25D 23/067; F25D 2201/14; F25D 23/082; F25D 23/066; F25D 23/062; B29L 2031/7622
See application file for complete search history.

(56) References Cited

U.S. PATENT DOCUMENTS 1,849,369 A 3/1932 Frost
1,921,576 A 8/1933 Muffly
(Continued)

FOREIGN PATENT DOCUMENTS

CA 626838 A 5/1961
CN 1276053 A 12/2000
(Continued)

OTHER PUBLICATIONS

Cai et al., "Generation of Metal Nanoparticles By Laser Ablation of Microspheres," J. Aerosol Sci., vol. 29, No. 5/6 (1998), pp. 627-636.
(Continued)

*Primary Examiner* — Stephen J Castellano
(74) *Attorney, Agent, or Firm* — Price Heneveld LLP

(57) ABSTRACT

A refrigerator includes a wrapper having an opening with a front edge. A liner includes an opening and a front edge. A thermal bridge interconnects the wrapper and the liner to form a vacuum insulated cavity therebetween. The thermal bridge includes an outwardly opening channel and first and second inwardly opening channels. The front edge of wrapper is received in the first inwardly opening channel, and the front edge of the liner is received in the second inwardly opening channel. The second inwardly opening channel is inset relative to the first inwardly opening channel on the thermal bridge. A conduit is disposed within the outwardly opening channel and is configured to circulate a heated medium. The wrapper and liner are contemplated to be comprised of conductive materials, such sheet metal, while
(Continued)

the thermal bridge is comprised of a thermally resistant material, such as a polymeric material.

7 Claims, 16 Drawing Sheets

Related U.S. Application Data a continuation-in-part of application No. 16/757,790, filed as application No. PCT/US2017/063947 on Nov. 30, 2017, now abandoned, said application No. 17/037,855 is a continuation of application No. 15/776,276, filed as application No. PCT/US2016/063966 on Nov. 29, 2016, now Pat. No. 10,808,987.

(60) Provisional application No. 62/265,055, filed on Dec. 9, 2015.

(56) References Cited

U.S. PATENT DOCUMENTS 2,002,366 A 5/1935 Eto
2,179,542 A 11/1939 Claxton et al.
2,191,659 A 2/1940 Hintze
2,432,042 A 12/1947 Richard
2,451,884 A 10/1948 Stelzer
2,729,863 A 1/1956 Kurtz
2,855,636 A * 10/1958 Donnelly ..... F25D 23/085 52/794.1
2,873,041 A 2/1959 Allen
3,290,893 A 12/1966 Haldopoulos
3,338,451 A * 8/1967 Kesling ..... F25D 23/082 220/592.08
3,353,301 A 11/1967 Heilweil et al.
3,353,321 A 11/1967 Heilweil et al.
3,408,316 A 10/1968 Mueller et al.
3,597,850 A 8/1971 Jenkins
3,607,169 A 9/1971 Coxe
3,632,012 A 1/1972 Kitson
3,633,783 A 1/1972 Aue
3,634,971 A 1/1972 Kesling
3,670,521 A 6/1972 Dodge, III et al.
3,769,770 A 11/1973 Deschamps et al.
3,862,880 A 1/1975 Feldman
3,868,829 A 3/1975 Mann et al.
3,869,873 A * 3/1975 Thomas ..... F25D 23/082 62/275
3,875,683 A 4/1975 Waters
3,910,658 A 10/1975 Lindenschmidt
3,933,398 A 1/1976 Haag
3,935,787 A 2/1976 Fisher
4,005,919 A 2/1977 Hoge et al.
4,134,518 A 1/1979 Menchen
4,170,391 A 10/1979 Bottger
4,242,241 A 12/1980 Rosen et al.
4,260,876 A 4/1981 Hochheiser
4,303,730 A 12/1981 Torobin
4,303,732 A 12/1981 Torobin
4,330,310 A 5/1982 Tate, Jr. et al.
4,396,362 A 8/1983 Thompson et al.
4,529,368 A 7/1985 Makansi
4,583,796 A 4/1986 Nakajima et al.
4,681,788 A 7/1987 Barito et al.
4,781,968 A 11/1988 Kellerman
4,831,780 A * 5/1989 Bockwinkel ..... F25D 23/082 49/478.1
4,860,921 A 8/1989 Gidseg
4,865,875 A 9/1989 Kellerman
4,870,735 A 10/1989 Jahr et al.
4,914,341 A 4/1990 Weaver et al.
5,066,437 A 11/1991 Barito et al.
5,084,320 A 1/1992 Barito et al.
5,094,899 A 3/1992 Rusek, Jr.
5,121,593 A 6/1992 Forslund
5,168,674 A 12/1992 Molthen
5,171,346 A 12/1992 Hallett
5,227,245 A 7/1993 Brands et al.
5,251,455 A 10/1993 Cur et al.
5,361,598 A 11/1994 Roseen
5,375,428 A 12/1994 LeClear et al.
5,500,287 A 3/1996 Henderson
5,500,305 A 3/1996 Bridges et al.
5,505,810 A 4/1996 Kirby et al.
5,509,248 A 4/1996 Dellby et al.
5,532,034 A 7/1996 Kirby et al.
5,533,311 A 7/1996 Tirrell et al.
5,599,081 A 2/1997 Revlett et al.
5,600,966 A 2/1997 Valence et al.
5,720,536 A * 2/1998 Jenkins ..... F25D 23/085 312/401
5,768,837 A 6/1998 Sjoholm
5,792,801 A 8/1998 Tsuda et al.
5,826,780 A 10/1998 Nesser et al.
5,834,126 A 11/1998 Sheu
5,918,478 A 7/1999 Bostic et al.
5,950,395 A 9/1999 Takemasa et al.
5,952,404 A 9/1999 Simpson et al.
6,013,700 A 1/2000 Asano et al.
6,029,457 A * 2/2000 Neeser ..... A47J 36/2494 62/46.1
6,056,383 A * 5/2000 Banicevic ..... F25D 23/082 312/401
6,063,471 A 5/2000 Dietrich et al.
6,163,976 A 12/2000 Tada et al.
6,164,739 A 12/2000 Schultz et al.
6,178,763 B1 1/2001 Brancheu et al.
6,187,256 B1 2/2001 Aslan et al.
6,209,342 B1 4/2001 Banicevic et al.
6,210,625 B1 4/2001 Matsushita et al.
6,244,458 B1 6/2001 Frysinger et al.
6,266,970 B1 7/2001 Nam et al.
6,294,595 B1 9/2001 Tyagi et al.
6,485,122 B2 1/2002 Wolf et al.
6,428,130 B1 8/2002 Banicevic et al.
6,430,780 B1 8/2002 Kim et al.
6,629,429 B1 10/2003 Kawamura et al.
6,655,766 B2 12/2003 Hodges
6,689,840 B1 2/2004 Eustace et al.
6,736,472 B2 5/2004 Banicevic
6,860,082 B1 3/2005 Yamamoto et al.
7,008,032 B2 3/2006 Chekal et al.
7,197,792 B2 4/2007 Moon
7,197,888 B2 4/2007 LeClear et al.
7,207,181 B2 4/2007 Murray et al.
7,234,247 B2 6/2007 Maguire
7,263,744 B2 9/2007 Kim et al.
7,360,371 B2 4/2008 Feinauer et al.
7,475,562 B2 1/2009 Jackovin
7,517,031 B2 4/2009 Laible
7,614,244 B2 11/2009 Venkatakrishnan et al.
7,665,326 B2 2/2010 LeClear et al.
7,703,217 B2 4/2010 Tada et al.
7,703,824 B2 4/2010 Kittelson et al.
7,757,511 B2 7/2010 LeClear et al.
7,794,805 B2 9/2010 Aumaugher et al.
7,845,745 B2 12/2010 Gorz et al.
7,938,148 B2 5/2011 Carlier et al.
7,992,257 B2 8/2011 Kim
8,049,518 B2 11/2011 Wern et al.
8,074,469 B2 12/2011 Hamel et al.
8,079,652 B2 12/2011 Laible et al.
8,108,972 B2 2/2012 Bae et al.
8,157,338 B2 4/2012 Seo et al.
8,162,415 B2 4/2012 Hagele et al.
8,182,051 B2 5/2012 Laible et al.
8,197,019 B2 6/2012 Kim
8,266,923 B2 9/2012 Bauer et al.
8,382,219 B2 2/2013 Hottmann et al.
8,434,317 B2 5/2013 Besore
8,439,460 B2 5/2013 Laible et al.
8,491,070 B2 7/2013 Davis et al.
8,516,845 B2 8/2013 Wuesthoff et al.
8,590,992 B2 11/2013 Lim et al.

(56) References Cited

U.S. PATENT DOCUMENTS

| | | | |
|---|---|---|---|
| 8,717,029 | B2 | 5/2014 | Chae et al. |
| 8,752,921 | B2 | 6/2014 | Gorz et al. |
| 8,763,847 | B2 | 7/2014 | Mortarotti |
| 8,764,133 | B2 | 7/2014 | Park et al. |
| 8,776,390 | B2 | 7/2014 | Hanaoka et al. |
| 8,840,204 | B2 | 9/2014 | Bauer et al. |
| 8,881,398 | B2 | 11/2014 | Hanley et al. |
| 8,905,503 | B2 | 12/2014 | Sahasrabudhe et al. |
| 8,943,770 | B2 | 2/2015 | Sanders et al. |
| 8,944,541 | B2 | 2/2015 | Allard et al. |
| 9,009,969 | B2 | 4/2015 | Choi et al. |
| RE45,501 | E | 5/2015 | Maguire |
| 9,056,952 | B2 | 6/2015 | Eilbracht et al. |
| 9,074,811 | B2 | 7/2015 | Korkmaz |
| 9,080,808 | B2 | 7/2015 | Choi et al. |
| 9,102,076 | B2 | 8/2015 | Doshi et al. |
| 9,103,482 | B2 | 8/2015 | Fujimori et al. |
| 9,125,546 | B2 | 9/2015 | Kleemann et al. |
| 9,139,756 | B2 | 9/2015 | Campbell |
| 9,140,480 | B2 | 9/2015 | Kuehl et al. |
| 9,140,481 | B2 | 9/2015 | Curr et al. |
| 9,170,045 | B2 | 10/2015 | Oh et al. |
| 9,170,046 | B2 | 10/2015 | Jung et al. |
| 9,188,382 | B2 | 11/2015 | Kim et al. |
| 8,955,352 | B2 | 12/2015 | Lee et al. |
| 9,221,210 | B2 | 12/2015 | Wu et al. |
| 9,228,386 | B2 | 1/2016 | Thielmann et al. |
| 9,267,727 | B2 | 2/2016 | Lim et al. |
| 9,303,915 | B2 | 4/2016 | Kim et al. |
| 9,328,951 | B2 | 5/2016 | Shin et al. |
| 9,353,984 | B2 | 5/2016 | Kim et al. |
| 9,410,732 | B2 | 8/2016 | Choi et al. |
| 9,423,171 | B2 | 8/2016 | Betto et al. |
| 9,429,356 | B2 | 8/2016 | Kim et al. |
| 9,441,779 | B1 | 9/2016 | Alshourbagy et al. |
| 9,448,004 | B2 | 9/2016 | Kim et al. |
| 9,463,917 | B2 | 10/2016 | Wu et al. |
| 9,482,463 | B2 | 11/2016 | Choi et al. |
| 9,506,689 | B2 | 11/2016 | Carbajal et al. |
| 9,518,777 | B2 | 12/2016 | Lee et al. |
| 9,568,238 | B2 | 2/2017 | Kim et al. |
| D781,641 | S | 3/2017 | Incukur |
| D781,642 | S | 3/2017 | Incukur |
| 9,605,891 | B2 | 3/2017 | Lee et al. |
| 9,696,085 | B2 | 7/2017 | Seo et al. |
| 9,702,621 | B2 | 7/2017 | Cho et al. |
| 9,759,479 | B2 | 9/2017 | Ramm et al. |
| 9,777,958 | B2 | 10/2017 | Choi et al. |
| 9,791,204 | B2 | 10/2017 | Kim et al. |
| 9,833,942 | B2 | 12/2017 | Wu et al. |
| 10,808,987 | B2 | 10/2020 | Allard et al. |
| 2002/0004111 | A1 | 1/2002 | Matsubara et al. |
| 2002/0114937 | A1 | 8/2002 | Albert et al. |
| 2002/0144482 | A1 | 10/2002 | Henson et al. |
| 2003/0056334 | A1 | 3/2003 | Finkelstein |
| 2003/0157284 | A1 | 8/2003 | Tanimoto et al. |
| 2003/0167789 | A1 | 9/2003 | Tanimoto et al. |
| 2003/0173883 | A1 | 9/2003 | Koons |
| 2004/0144130 | A1 | 7/2004 | Jung |
| 2004/0226141 | A1 | 11/2004 | Yates et al. |
| 2005/0042247 | A1 | 2/2005 | Gomoll et al. |
| 2005/0229614 | A1 | 10/2005 | Ansted |
| 2006/0064846 | A1 | 3/2006 | Espendola et al. |
| 2006/0261718 | A1 | 11/2006 | Miseki et al. |
| 2006/0266075 | A1 | 11/2006 | Itsuki et al. |
| 2007/0266654 | A1 | 11/2007 | Noale |
| 2007/0277923 | A1 | 12/2007 | Wood et al. |
| 2008/0044488 | A1 | 2/2008 | Zimmer et al. |
| 2008/0048540 | A1 | 2/2008 | Kim |
| 2008/0138458 | A1 | 6/2008 | Ozasa et al. |
| 2008/0196441 | A1 | 8/2008 | Ferreira |
| 2009/0032541 | A1 | 2/2009 | Rogala et al. |
| 2009/0126765 | A1 | 5/2009 | Buehlmeyer et al. |
| 2009/0131571 | A1 | 5/2009 | Fraser et al. |
| 2009/0205357 | A1 | 8/2009 | Lim et al. |
| 2009/0302728 | A1 | 12/2009 | Rotter et al. |
| 2009/0322470 | A1 | 12/2009 | Yoo et al. |
| 2010/0206464 | A1 | 8/2010 | Heo et al. |
| 2010/0218543 | A1 | 9/2010 | Duchame |
| 2010/0287843 | A1 | 11/2010 | Oh |
| 2010/0287974 | A1 | 11/2010 | Cur et al. |
| 2011/0011119 | A1 | 1/2011 | Kuehl et al. |
| 2011/0023527 | A1 | 2/2011 | Kwon et al. |
| 2011/0039108 | A1 | 2/2011 | Goeb et al. |
| 2011/0095669 | A1 | 4/2011 | Moon et al. |
| 2011/0215694 | A1 | 9/2011 | Fink et al. |
| 2011/0220662 | A1 | 9/2011 | Kim et al. |
| 2011/0309732 | A1 | 12/2011 | Horil et al. |
| 2012/0011879 | A1 | 1/2012 | Gu |
| 2012/0060544 | A1 | 3/2012 | Lee et al. |
| 2012/0099255 | A1 | 4/2012 | Lee et al. |
| 2012/0104002 | A1* | 5/2012 | Jung ..... F25D 23/085 220/592.27 |
| 2012/0240612 | A1 | 9/2012 | Wusthoff et al. |
| 2012/0280608 | A1 | 11/2012 | Park et al. |
| 2013/0026900 | A1 | 1/2013 | Oh et al. |
| 2013/0043780 | A1 | 2/2013 | Ootsuka et al. |
| 2013/0221819 | A1 | 8/2013 | Wing |
| 2013/0270732 | A1 | 10/2013 | Wu et al. |
| 2013/0285527 | A1 | 10/2013 | Choi et al. |
| 2013/0293080 | A1 | 11/2013 | Kim et al. |
| 2014/0009055 | A1 | 1/2014 | Cho et al. |
| 2014/0097733 | A1 | 4/2014 | Seo et al. |
| 2014/0166926 | A1 | 6/2014 | Lee et al. |
| 2014/0190978 | A1 | 7/2014 | Bowman et al. |
| 2014/0216706 | A1 | 8/2014 | Melton et al. |
| 2014/0232250 | A1 | 8/2014 | Kim et al. |
| 2014/0346942 | A1 | 11/2014 | Kim et al. |
| 2015/0011668 | A1 | 1/2015 | Kolb et al. |
| 2015/0015133 | A1 | 1/2015 | Carbajal et al. |
| 2015/0017386 | A1 | 1/2015 | Kolb et al. |
| 2015/0059399 | A1 | 3/2015 | Hwang et al. |
| 2015/0115790 | A1 | 4/2015 | Ogg |
| 2015/0159936 | A1 | 6/2015 | Oh et al. |
| 2015/0176888 | A1 | 6/2015 | Cur et al. |
| 2015/0184923 | A1 | 7/2015 | Jeon |
| 2015/0190840 | A1 | 7/2015 | Muto et al. |
| 2015/0224685 | A1 | 8/2015 | Amstutz |
| 2015/0241115 | A1 | 8/2015 | Strauss et al. |
| 2015/0241118 | A1 | 8/2015 | Wu |
| 2015/0285551 | A1 | 10/2015 | Aiken et al. |
| 2016/0084567 | A1 | 3/2016 | Fernandez et al. |
| 2016/0116100 | A1 | 4/2016 | Thiery et al. |
| 2016/0123055 | A1 | 5/2016 | Ueyama |
| 2016/0161175 | A1 | 6/2016 | Benold et al. |
| 2016/0178267 | A1 | 6/2016 | Hao et al. |
| 2016/0178269 | A1 | 6/2016 | Hiemeyer et al. |
| 2016/0235201 | A1 | 8/2016 | Soot |
| 2016/0240839 | A1 | 8/2016 | Umeyama et al. |
| 2016/0258671 | A1 | 9/2016 | Allard et al. |
| 2016/0290702 | A1 | 10/2016 | Sexton et al. |
| 2016/0348957 | A1 | 12/2016 | Hitzelberger et al. |
| 2017/0038126 | A1 | 2/2017 | Lee et al. |
| 2017/0157809 | A1 | 6/2017 | Deka et al. |
| 2017/0176086 | A1 | 6/2017 | Kang |
| 2017/0184339 | A1 | 6/2017 | Liu et al. |
| 2017/0191746 | A1 | 7/2017 | Seo |

FOREIGN PATENT DOCUMENTS

| | | | |
|---|---|---|---|
| CN | 101539361 | A | 9/2009 |
| CN | 201748744 | U | 2/2011 |
| CN | 102331145 | A | 1/2012 |
| CN | 102455105 | A | 5/2012 |
| CN | 102717578 | A | 10/2012 |
| CN | 202973713 | U | 6/2013 |
| CN | 104816478 | A | 8/2015 |
| CN | 105115221 | | 12/2015 |
| CN | 2014963379 | U | 1/2016 |
| DE | 4110292 | A1 | 10/1992 |
| DE | 4409091 | | 9/1995 |
| DE | 19648305 | A1 | 5/1998 |
| DE | 19914105 | | 9/2000 |
| DE | 10114633 | A1 | 9/2002 |

(56) References Cited

FOREIGN PATENT DOCUMENTS

| | | | |
|---|---|---|---|
| DE | 102011051178 | A1 | 12/2012 |
| DE | 102014206559 | A1 | 10/2015 |
| EP | 0645576 | A1 | 3/1995 |
| EP | 1602425 | A1 | 12/2005 |
| EP | 1624263 | A2 | 8/2006 |
| EP | 2543942 | A2 | 1/2013 |
| EP | 2878427 | A1 | 6/2015 |
| FR | 2991698 | A1 | 12/2013 |
| JP | 52119168 | A | 10/1977 |
| JP | 59229163 | A | 12/1984 |
| JP | S60138381 | A | 7/1985 |
| JP | 404165197 | | 6/1992 |
| JP | 04165197 | | 10/1992 |
| JP | 04309778 | A | 11/1992 |
| JP | 11159693 | A | 6/1999 |
| JP | H11201627 | A | 7/1999 |
| JP | 2000320958 | A | 11/2000 |
| JP | 2002068853 | | 3/2002 |
| JP | 3438948 | B2 | 8/2003 |
| JP | 2005069596 | A | 3/2005 |
| JP | 2005098637 | A | 4/2005 |
| JP | 2006161834 | A | 6/2006 |
| JP | 2006200685 | A | 8/2006 |
| JP | 2008039364 | A | 2/2008 |
| JP | 2008190815 | | 8/2008 |
| JP | 2009287791 | A | 12/2009 |
| JP | 2013050267 | A | 3/2013 |
| JP | 2013076471 | A | 4/2013 |
| KR | 20050095357 | A | 9/2005 |
| KR | 100620025 | B1 | 9/2006 |
| KR | 1020070065743 | A | 6/2007 |
| KR | 20090026045 | | 3/2009 |
| KR | 20150089495 | A | 8/2015 |
| RU | 2061925 | C1 | 6/1996 |
| RU | 2077411 | C1 | 4/1997 |
| RU | 2081858 | | 6/1997 |
| RU | 2132522 | C2 | 6/1999 |
| RU | 2162576 | C2 | 1/2001 |
| RU | 2166158 | C1 | 4/2001 |
| RU | 2187433 | C2 | 8/2002 |
| RU | 2234645 | C1 | 8/2004 |
| RU | 2252377 | | 5/2005 |
| RU | 2253792 | C2 | 6/2005 |
| RU | 2349618 | C2 | 3/2009 |
| RU | 2414288 | C2 | 3/2011 |
| RU | 2422598 | | 6/2011 |
| RU | 142892 | | 7/2014 |
| RU | 2529525 | C1 | 9/2014 |
| RU | 2571031 | | 12/2015 |
| SU | 203707 | | 12/1967 |
| SU | 00476407 | A1 | 7/1975 |
| SU | 547614 | | 5/1977 |
| SU | 648780 | A1 | 2/1979 |
| SU | 01307186 | A1 | 4/1987 |
| WO | 9204301 | A1 | 3/1992 |
| WO | 9614207 | A1 | 5/1996 |
| WO | 9721767 | | 6/1997 |
| WO | 9920961 | A1 | 4/1999 |
| WO | 9920964 | | 4/1999 |
| WO | 200160598 | | 8/2001 |
| WO | 200202987 | | 1/2002 |
| WO | 2002052208 | | 4/2002 |
| WO | 02060576 | A1 | 8/2002 |
| WO | 03072684 | A1 | 9/2003 |
| WO | 2004010042 | A1 | 1/2004 |
| WO | 2006045694 | | 5/2006 |
| WO | 2006073540 | A2 | 7/2006 |
| WO | 2007033836 | A1 | 3/2007 |
| WO | 2007106067 | A2 | 9/2007 |
| WO | 2008065453 | | 6/2008 |
| WO | 2008077741 | A2 | 7/2008 |
| WO | 2008118536 | A2 | 10/2008 |
| WO | 200812248342 | A2 | 10/2008 |
| WO | 2009013106 | A2 | 1/2009 |
| WO | 2009112433 | A1 | 9/2009 |
| WO | 2010007783 | A1 | 1/2010 |
| WO | 2010127947 | A2 | 11/2010 |
| WO | 2011058678 | A1 | 5/2011 |
| WO | 2012152646 | A2 | 11/2012 |
| WO | 2013116103 | | 8/2013 |
| WO | 2013116302 | | 8/2013 |
| WO | 2014038150 | A1 | 3/2014 |
| WO | 2014121893 | A1 | 8/2014 |
| WO | 2014184393 | A1 | 11/2014 |
| WO | 2013140816 | A1 | 8/2015 |
| WO | 2016082907 | A1 | 6/2016 |
| WO | 2017029782 | A1 | 2/2017 |
| WO | 2017100037 | A1 | 6/2017 |
| WO | 2017192121 | A1 | 11/2017 |

OTHER PUBLICATIONS

Raszewski et al., "Methods For Producing Hollow Glass Microspheres," Powerpoint, cached from Google, Jul. 2009, 6 pages.

* cited by examiner

VACUUM INSULATED STRUCTURE WITH THERMAL BRIDGE BREAKER WITH HEAT LOOP

CROSS-REFERENCE TO RELATED APPLICATION

This application is a continuation-in-part of U.S. application Ser. No. 16/757,790, filed on Apr. 21, 2020, entitled "VACUUM INSULATED STRUCTURE WITH THERMAL BRIDGE BREAKER WITH HEAT LOOP," now abandoned, which is a National Stage Application under 35 U.S.C. § 371 of International Application No. PCT/US2017/063947, filed on Nov. 30, 2017, entitled "VACUUM INSULATED STRUCTURE WITH THERMAL BRIDGE BREAKER WITH HEAT LOOP." This application is also a continuation-in-part of U.S. application Ser. No. 17/037,855, filed on Sep. 30, 2020, entitled "VACUUM INSULATION STRUCTURES WITH MULTIPLE INSULATORS," now U.S. Pat. No. 11,555,643, which is a continuation of U.S. patent application Ser. No. 15/776,276 entitled "VACUUM INSULATION STRUCTURES WITH MULTIPLE INSULATORS," filed May 15, 2018 (now U.S. Pat. No. 10,808,987) which is a national stage entry of PCT/US2016/063966, filed on Nov. 29, 2016, which claims the benefit under 35 U.S.C. § 119(e) to U.S. Provisional Patent Application No. 62/265,055 filed Dec. 9, 2015. The entire disclosures of each are incorporated herein by reference in their entireties.

BACKGROUND

The present device generally relates to insulated structures, in particular, to a vacuum insulated refrigerator cabinet that includes a thermal bridge breaker that includes a heat loop and interconnects a wrapper and one or more liners and cooperates with the liners to define refrigerated storage compartments.

Various types of insulated refrigerator cabinet structures have been developed. One type of insulated structure includes a wrapper and a liner. The wrapper and liner are generally spaced-apart to form a cavity therebetween that is filled with an insulating material. In a vacuum insulated refrigerator structure, this cavity may be filled with a vacuum insulated core material. In order to hold the vacuum, it is necessary to provide an airtight seal between the wrapper, one or more liners, and the thermal bridge breaker. Further, thermal conduction between component parts of a refrigerator is sought to be avoided to reduce condensation.

SUMMARY

In at least one aspect of the present concept, a refrigerator includes a wrapper having a first opening and a first edge extending around the first opening. A liner includes a second opening and a second edge extending around the second opening. In assembly, the liner is disposed inside the wrapper. A thermal bridge interconnects the wrapper and the liner to form cavity therebetween. The thermal bridge includes a body portion having first and second channels opening in a first direction and a third channel opening in a second direction that is opposed to the first direction. The first and second edges of the wrapper and liner are disposed in the first and second channels, respectively. Tubing for a heat loop is received in the third channel and is configured to circulate a heated medium.

In at least another aspect of the present concept, a refrigerator includes a wrapper having an opening and a front edge extending around the opening of the wrapper. A liner includes an opening and a front edge extending around the opening of the liner. A thermal bridge interconnects the wrapper and the liner to form a vacuum insulated cavity therebetween. The thermal bridge includes a body portion having an outwardly opening channel disposed on a front side of the thermal bridge and first and second inwardly opening channels disposed on a rear side of the thermal bridge. The front edge of wrapper is received in the first inwardly opening channel of the thermal bridge, and the front edge of the liner is received in the second inwardly opening channel of the thermal bridge. The second inwardly opening channel is inset relative to the first inwardly opening channel on the thermal bridge.

In yet another aspect of the present concept, a refrigerator includes a wrapper having a first opening and a first edge extending around the first opening. A liner includes a second opening and a second edge extending around the second opening. A thermal bridge includes a first portion with a first channel disposed thereon, and further includes a second portion inwardly extending from the first portion and having a second channel disposed thereon. The first and second channels are vertically and horizontally offset from one another, and the first and second edges are received in the first and second channels, respectively. A refrigerated compartment includes an outer opening. The refrigerated compartment includes a front portion defined by the second portion of the thermal bridge and a rear portion defined by the liner. The second edge of the liner is inset from the outer opening of the refrigerated compartment.

According to another aspect of the present disclosure, a refrigerator cabinet is provided. The refrigerator cabinet includes an inner liner and an external wrapper. The inner liner is positioned within the external wrapper such that a gap is defined between the external wrapper and inner liner. A first insulator is positioned within the gap, and a second insulator is positioned within the gap. A pressure within the gap is below about 1000 Pa.

According to another aspect of the present disclosure, a refrigerator cabinet includes an inner liner and an external wrapper. The inner liner is positioned within the external wrapper such that a gap is defined between the external wrapper and internal liner. A first insulator is positioned within the gap. A second insulator is positioned within the gap. The first and second insulators are segregated.

According to another aspect of the present disclosure, a refrigerator cabinet includes an inner liner and an external wrapper. The inner liner is positioned within the external wrapper. A first insulator is positioned proximate a front flange of the cabinet. A second insulator is positioned proximate the first insulator.

These and other features, advantages, and objects of the present device will be further understood and appreciated by those skilled in the art upon studying the following specification, claims, and appended drawings.

DETAILED DESCRIPTION OF EMBODIMENTS

Figure 1:
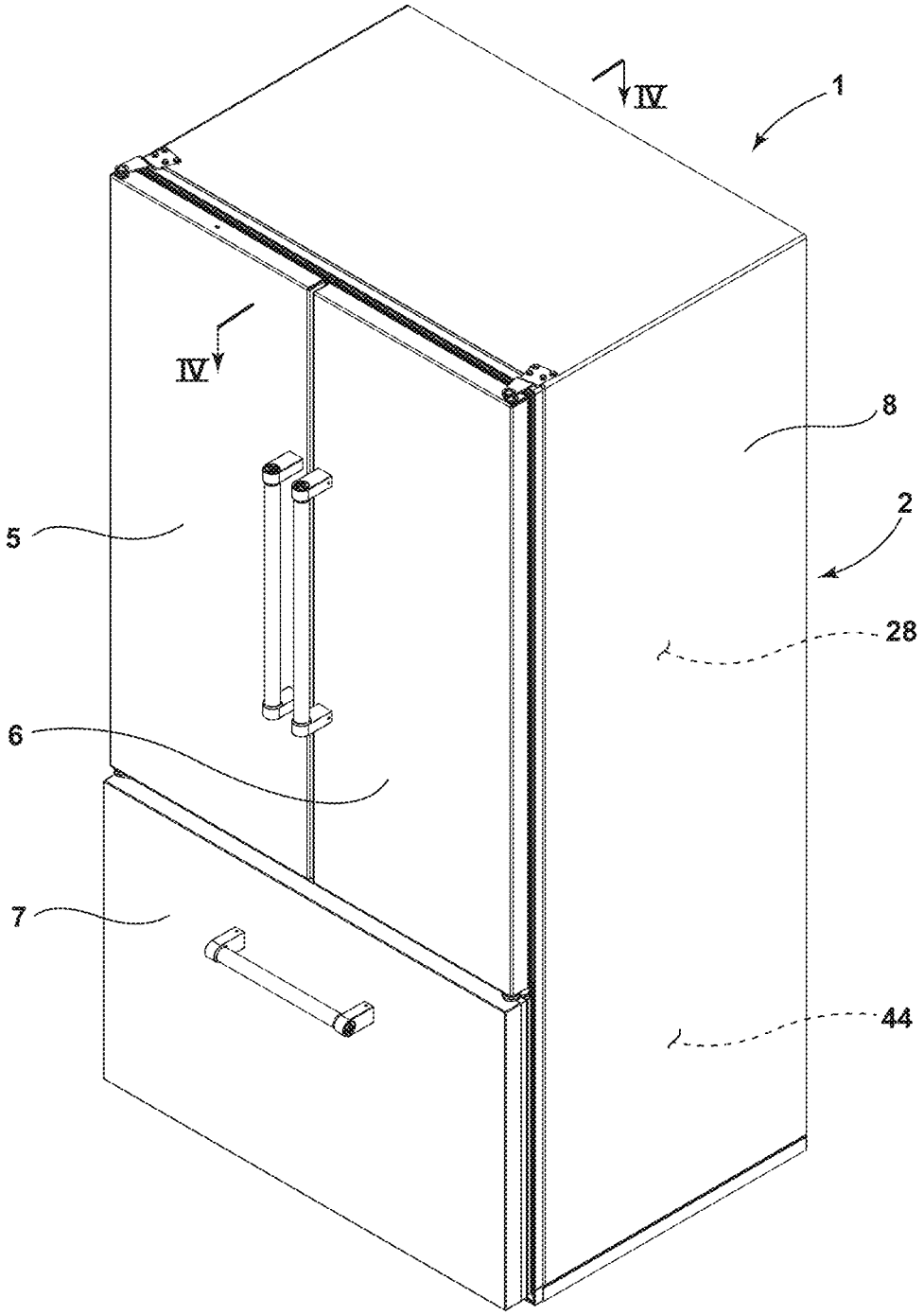
FIG. 1 is isometric view of a refrigerator including a vacuum insulated cabinet structure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Further, the terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

With reference to FIG. 1, a refrigerator 1 includes a vacuum insulated cabinet structure 2 which, in the embodiment of FIG. 1, further includes a refrigerator compartment 28 positioned above a freezer compartment 44. Doors 5 and 6 are provided to selectively provide access to the refrigerator compartment 28, while a drawer 7 is used to provide access to the freezer compartment 44. The vacuum insulated cabinet structure 2 is surrounded by an exterior wrapper 8 in assembly. The configuration of the refrigerator 1 is exemplary only and the present concept is contemplated for use in all refrigerator styles including, but not limited to, side-by-side refrigerators, whole refrigerator and freezers, and refrigerators with upper freezer compartments.

Figure 2:
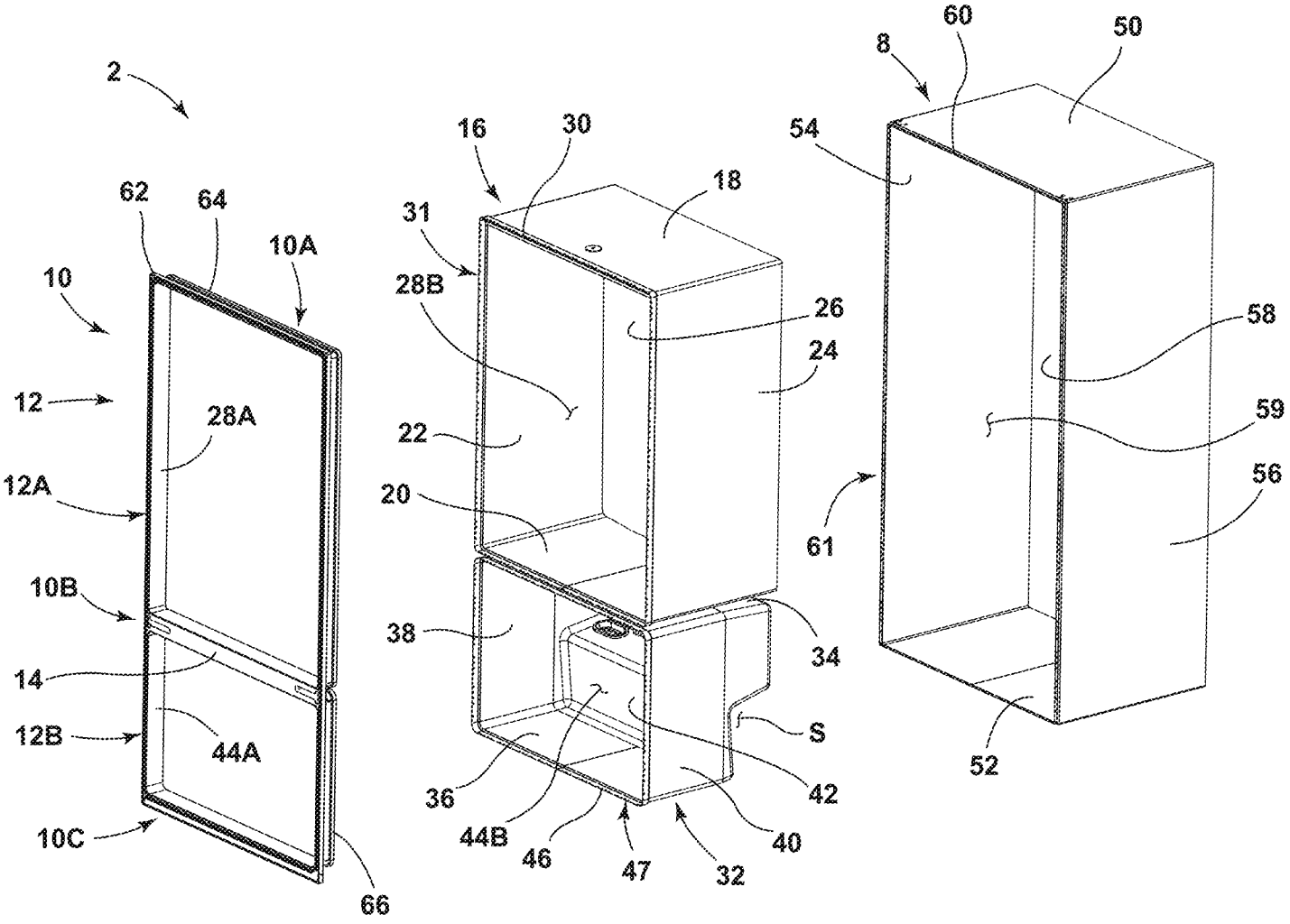
FIG. 2 is an exploded isometric view of a vacuum insulated cabinet structure.

Referring now to FIG. 2, the vacuum insulated cabinet structure 2 generally includes a thermal bridge 10. In the embodiment shown in FIG. 2, the thermal bridge 10, or thermal breaker, includes a frame 12 having an upper opening 12A and a lower opening 12B with a mullion portion 14 disposed therebetween. The thermal bridge 10 further includes an upper portion 10A, a middle portion 10B and a lower portion 10C. A rear portion of the upper opening 12A of the thermal bridge 10 defines a front portion 28A of a refrigerator compartment 28 (FIGS. 3 and 4), as further described below, when the vacuum insulated cabinet structure 2 is assembled. Similarly, a rear portion of the lower opening 12B of the thermal bridge 10 defines a front portion 44A of a freezer compartment 44 (FIGS. 3 and 4), as further described below, when the vacuum insulated cabinet structure 2 is assembled. The thermal bridge 10 may be referred to herein as a trim breaker, such as the trim breaker 172 shown in FIG. 12C. Thus, the description of the thermal bridge 10 also describes the trim breaker 172, as shown in FIG. 12C.

As shown in the embodiment of FIG. 2, the vacuum insulated cabinet structure 2 further includes a refrigerator liner 16 having a top wall 18, a bottom wall 20, opposed sidewalls 22, 24, and a rear wall 26. Together, the walls 18, 20, 22, and 24 cooperate to define a rear portion 28B of the refrigerator compartment 28 when the vacuum insulated cabinet structure 2 is assembled (see FIGS. 3 and 4). The refrigerator liner 16 further includes a front edge 30 disposed on a front portion thereof. The front edge 30 is disposed along the top wall 18, the bottom wall 20 and the opposed sidewalls 22, 24 in a quadrilateral ring configuration. The refrigerator liner 16 may be referred to herein as an inner liner, such as inner liner 118 shown in FIG. 12C. Thus, the description of the refrigerator liner 16 (and the front edge 30, the transverse portion 82 and the flange portion 84 thereof) also describes the inner liner 118 shown in FIG. 12C.

As further shown in the embodiment of FIG. 2, a freezer liner 32 is provided and includes a top wall 34, a bottom wall 36, opposed sidewalls 38, 40, and a rear wall 42. Together, the walls 34, 36, 38, and 40 cooperate to define a rear portion 44B of the freezer compartment 44 when the vacuum insulated cabinet structure 2 is assembled (see FIGS. 3 and 4). The rear wall 42 is shown in FIG. 2 as being a contoured rear wall that provides a spacing S for housing mechanical equipment 43 (FIG. 4) for cooling both the refrigerator compartment 28 and freezer compartment 44. Such equipment may include a compressor, a condenser, an expansion valve, an evaporator, a plurality of conduits, and other related components used for cooling the refrigerator and freezer compartments 28, 44. As further shown in the embodiment of FIG. 2, the freezer liner 32 includes a front edge 46 disposed on a front portion thereof. The front edge 46 is disposed along the top wall 34, the bottom wall 36 and the opposed sidewalls 38, 40 in a quadrilateral ring configuration. In assembly, the front edge 30 of the refrigerator liner 16 and the front edge 46 of the freezer liner 32 define first and second openings 31, 47 that are configured to couple with coupling portions disposed about the upper and lower openings 12A, 12B of the thermal bridge 10, as further described below.

As further shown in FIG. 2, the vacuum insulated cabinet structure 2 further includes the exterior wrapper 8 which, in the embodiment of FIG. 2, includes a top wall 50, a bottom wall 52, opposed sidewalls 54, 56, and a rear wall 58 which cooperate to define a cavity 59. The wrapper 8 further includes a front edge 60 which is disposed along an opening 61 of the cavity 59 which is further disposed along the top wall 50, the bottom wall 52, and the opposed sidewalls 54, 56 so as to be a circumventing frontmost edge 60 of the exterior wrapper 8 presented in a quadrilateral ring configuration. In assembly, the front edge 60 of the exterior wrapper 8 is coupled to coupling portions of the thermal bridge 10 around the liners 16, 32. In this way, the thermal bridge 10 interconnects the exterior wrapper 8 and the refrigerator liner 16 and the freezer liner 32 when assembled. Further, the refrigerator liner 16 and freezer liner 32 are received within the cavity 59 of the exterior wrapper 8 when assembled, such that there is a spacing VC (FIG. 3) between the outer surfaces of the refrigerator liner 16 and the freezer liner 32 relative to the inner surfaces of the exterior wrapper 8. In this way, the spacing can be used to create a vacuum insulated cavity, as further described below. The spacing VC may be referred to herein as a gap 126 (FIG. 12C) or a vacuum insulated cavity positioned between the exterior wrapper 8 and refrigerator liner 16 and the freezer liner 32. The exterior wrapper 8 may be referred to herein as an external wrapper, such as external wrapper 122 shown in FIG. 12C. Thus, the description of the exterior wrapper 8 (and the front edge 60, the transverse portion 76 and the flange portion 78 thereof) also describes the external wrapper 122 shown in FIG. 12C.

The wrapper 8 may be made from sheet metal, polymer materials, or other suitable materials. For purposes of the present concept, the wrapper 8 is contemplated to be made from a sheet metal material that is formed utilizing known steel forming tools and processes. The refrigerator liner 16 and the freezer liner 32 are also preferably made from a sheet metal material utilizing known steel forming tools and processes.

Figure 3:
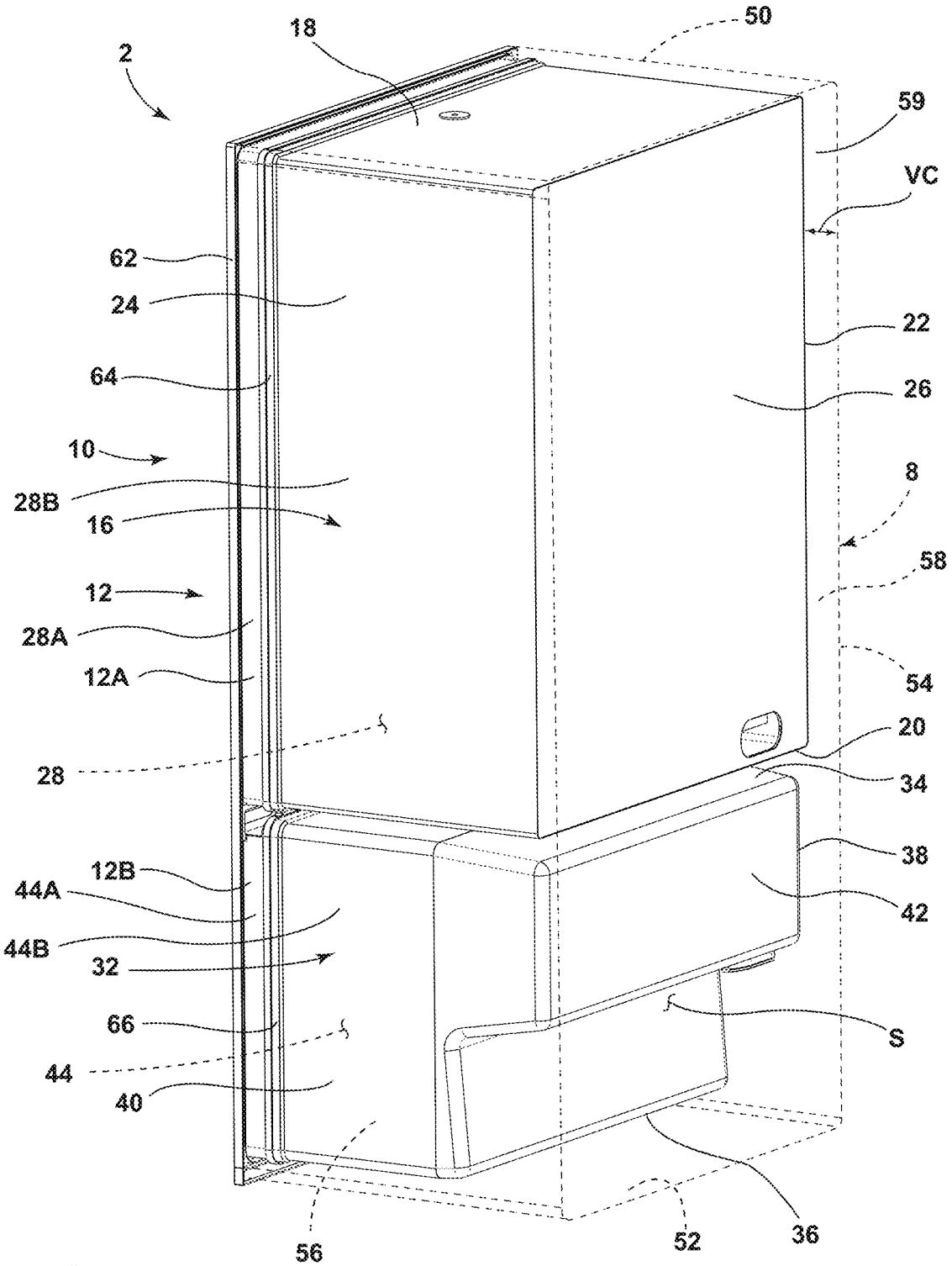
FIG. 3 is a rear isometric view of the vacuum insulated cabinet structure of FIG. 2 as assembled.

The thermal bridge 10 may be formed from a material having a low thermal conductivity. For example, the thermal bridge 10 may be fabricated by thermoforming a sheet of thermoplastic polymer material. The thermal bridge 10 may be constructed of a material that is substantially impervious, such that oxygen, nitrogen, carbon dioxide, water vapor, and/or other atmospheric gasses are sealed out of the vacuum cavity VC (FIG. 3) defined in the spacing or gap that is formed between the wrapper 8 and liners 16, 32 as discussed in more detail below. The thermal bridge 10 may comprise a plurality of layers, wherein layers of polymeric material are selected to provide impermeability to gasses, such that the thermal bridge 10 provides for an air-tight connection between the wrapper 8 and the liners 16, 32 which allows for a vacuum to be held between the thermal bridge 10, the wrapper 8 and the liners 16, 32 in the vacuum cavity VC (FIG. 3). The thermal bridge 10 may also be formed from any suitable material that is substantially impervious to gasses to maintain a vacuum in the vacuum cavity VC. The material used to comprise the thermal bridge 10 is also contemplated to have a low coefficient of thermal conductivity to reduce or prevent transfer of heat between the metal wrapper 8 and the metal liners 16, 32 which have a high coefficient of thermal conductivity. For use with the present concept, the thermal bridge 10 is preferably formed utilizing a molding process, and specifically, may include a reaction injection molding (RIM) process as further described below. In an RIM process, the thermal bridge 10 is likely formed in a mold using a polyurethane material. Other materials suitable for an RIM process may include, but are not limited to, polyureas, polyisocyanurates, polyesters, polyphenols, polyepoxides, thermoplastic elastomers, polycarbonate, and nylon materials. Using an RIM process of the present concept, the thermal bridge 10 could be overmolded to the refrigerator liner 16, the freezer liner 32 and the wrapper 8 at the respective front edges 30, 46, 60 thereof. In this way, the vacuum insulated cabinet structure 2 can be a unitary part after the thermal bridge 10 is cast onto the front edges 30, 46, 60, of the liners 16, 32 and the wrapper 8. Thus, the thermal bridge 10 can be comprised entirely of a material having a low thermal conductivity (such as glass, ceramic, or polymeric materials), or can by partially comprised of such materials.

As shown in FIG. 2, the front edge 30 of the refrigerator liner 16 includes linear portions disposed around the top wall 18, bottom wall 20 and opposed sidewalls 22, 24 at front portions thereof, such that front edge 30 of the refrigerator liner 16 is generally quadrilateral. As further shown in FIG. 2, the front edge 46 of the freezer liner 32 includes linear portions disposed around the top wall 34, bottom wall 36 and opposed sidewalls 38, 40 at front portions thereof, such that front edge 46 of the freezer liner 32 is also generally quadrilateral. As depicted in FIG. 2, and further shown in FIG. 3, the profile of the combination of the liners 16, 32 is preferably somewhat smaller than the profile of the wrapper 8. In this way, the vacuum cavity VC (FIG. 3) is formed within the spacing defined between the liners 16, 32 and the wrapper 8 when the liners 16, 32 are positioned inside the cavity 59 of the wrapper 8. The vacuum cavity VC is configured to receive an insulating material (not shown) that may be described as a vacuum core material. The vacuum core material may comprise a plurality of preformed individual core panels that are preformed and positioned between wrapper 8 and the liners 16, 32 during assembly prior to the installation of the thermal bridge 10. Alternatively, the vacuum core material may comprise silica powder or other suitable loose filler material that is inserted (e.g. blown) into the vacuum cavity VC after wrapper 8, liners 16, 32, and thermal bridge 10 are formed into a unitary composite structure.

As configured in assembly, the front edges 30, 46 of the liners 16, 32 are spaced-apart from each other at the linear portions thereof disposed along the bottom wall 20 of the refrigerator liner 16 and the linear portion disposed along the top wall 34 of the freezer liner 32. Further, the front edges 30, 46 of the liners 16, 32 disposed along the opposed sidewalls 22, 24 and 38, 40 of the liners 16, 32, and the top wall 18 of the refrigerator liner 16 and the bottom wall 36 of the freezer liner 32 are spaced-apart from the linear portions defining the front edge 60 of the wrapper 8 in assembly.

Referring now to FIG. 3, when the vacuum insulated cabinet structure 2 is assembled, the thermal bridge 10 connects to the front edge 60 of the wrapper 8, and further connects to the front edge 30 of the refrigerator liner 16, and to the front edge 46 of the freezer liner 32, thereby interconnecting the components. In this way, the thermal bridge 10 interconnects the wrapper 8 and the liners 16, 32. When refrigerator 1 (FIG. 1) is in use, the wrapper 8 is typically exposed to ambient room temperature air, whereas the liners 16, 32 are generally exposed to refrigerated air in the refrigerator compartment 28 or the freezer compartment 44. With the thermal bridge 10 being made of a material that is substantially non-conductive with respect to heat, the thermal bridge 10 reduces transfer of heat from the wrapper 8 to the liners 16, 32.

The thermal bridge 10 may include linear portions that are interconnected to form a ring-like structure having a quadrilateral perimeter or outer coupling portion 62 and quadrilateral inner coupling portions 64, 66. The inner coupling portions 64, 66 define upper and lower openings 12A, 12B that generally correspond to the openings 31, 47 defined by the front edges 30, 46 of the refrigerator liner 16, and freezer liner 32 of the cabinet structure 2. In assembly, the outer coupling portion 62 is coupled to the front edge 60 of the wrapper 8. Further, the inner coupling portions 64, 66 are disposed inside of the outer coupling portion 62 and set back therefrom, as further described below. In assembly, the inner coupling portions 64, 66 are coupled to the front edges 30, 46 of the refrigerator liner 16, and freezer liner 32, respectively. It will be understood that the thermal bridge 10 may have various shapes and configurations as may be required for a particular application, and it is further contemplated that the thermal bridge 10 can be used in a refrigerator having multiple liners (as shown in FIG. 2 with a refrigerator liner 16 and a freezer liner 32) or in a refrigerator having a single liner for use as a refrigerator or freezer only. The outer coupling portion 62 may be referred to herein as a wrapper joint, such as wrapper joint 172B shown in FIG. 12C. Thus, the description of the outer coupling portion 62 (and the first channel 67 thereof) also describes the wrapper joint 172B shown in FIG. 12C. The inner coupling portion 64 may be referred to herein as a liner joint, such as liner joint 172A shown in FIG. 12C. Thus, the description of the inner coupling portion 64 (and the second channel 69 thereof) also describes the wrapper joint 172B shown in FIG. 12C.

Figure 4:
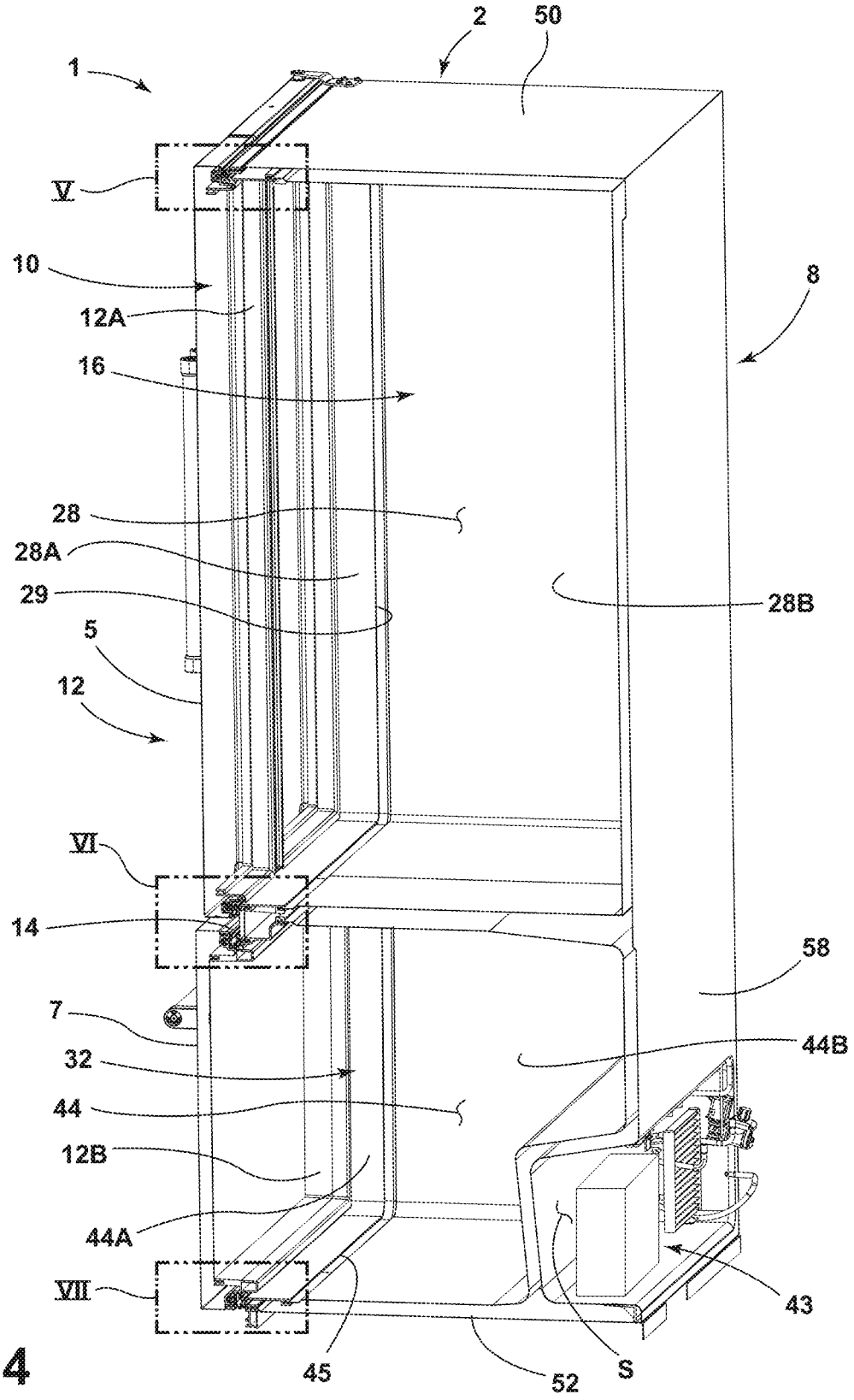
FIG. 4 is a cross-sectional view of the refrigerator of FIG. 1 taken at line IV.

Referring now to FIG. 4, the refrigerator 1 is shown in a cross-sectional view having the refrigerator liner 16 and freezer liner 32 coupled to the thermal bridge 10 at upper and lower openings 12A, 12B, respectively. Further, the wrapper 8 is also coupled to the thermal bridge 10, such that the thermal bridge 10 interconnects the wrapper 8 with the refrigerator liner 16 and freezer liner 32. Specifically, the thermal bridge 10 of the present concept is coupled to the liners 16, 32 and wrapper 8 to hermetically seal the components together as a unitary whole as shown in FIG. 3. In the cross-sectional view if FIG. 4, the thermal bridge 10 is shown as defining the front portion 28A of the refrigerator compartment 28, with the refrigerator liner 16 defining the rear portion 28B of the refrigerator compartment 28. A mating joint between the refrigerator liner 16 and the thermal bridge 10 is identified at reference numeral 29. Further, in the cross-sectional view if FIG. 4, the thermal bridge 10 is shown as defining the front portion 44A of the freezer compartment 44, with the freezer liner 32 defining the rear portion 44B of the freezer compartment 44. A mating joint between the freezer liner 32 and the thermal bridge 10 is identified at reference numeral 45. With the thermal bridge 10 providing the front portions 28A, 44A of the refrigerator compartment 28 and the freezer compartment 44, respectively, the metal materials of the cooled liners 16, 32 are inset from the surfaces of the refrigerator that are exposed to ambient room temperatures, such as the metal wrapper 8 and a sealing surface of the thermal bridge 10. In this way, the configuration of the thermal bridge 10 insulates the highly conductive metallic materials of the liners 16, 32 from the areas most prone to conductive heat influences. The overall configuration of the thermal bridge 10 is further described below.

Figure 5:
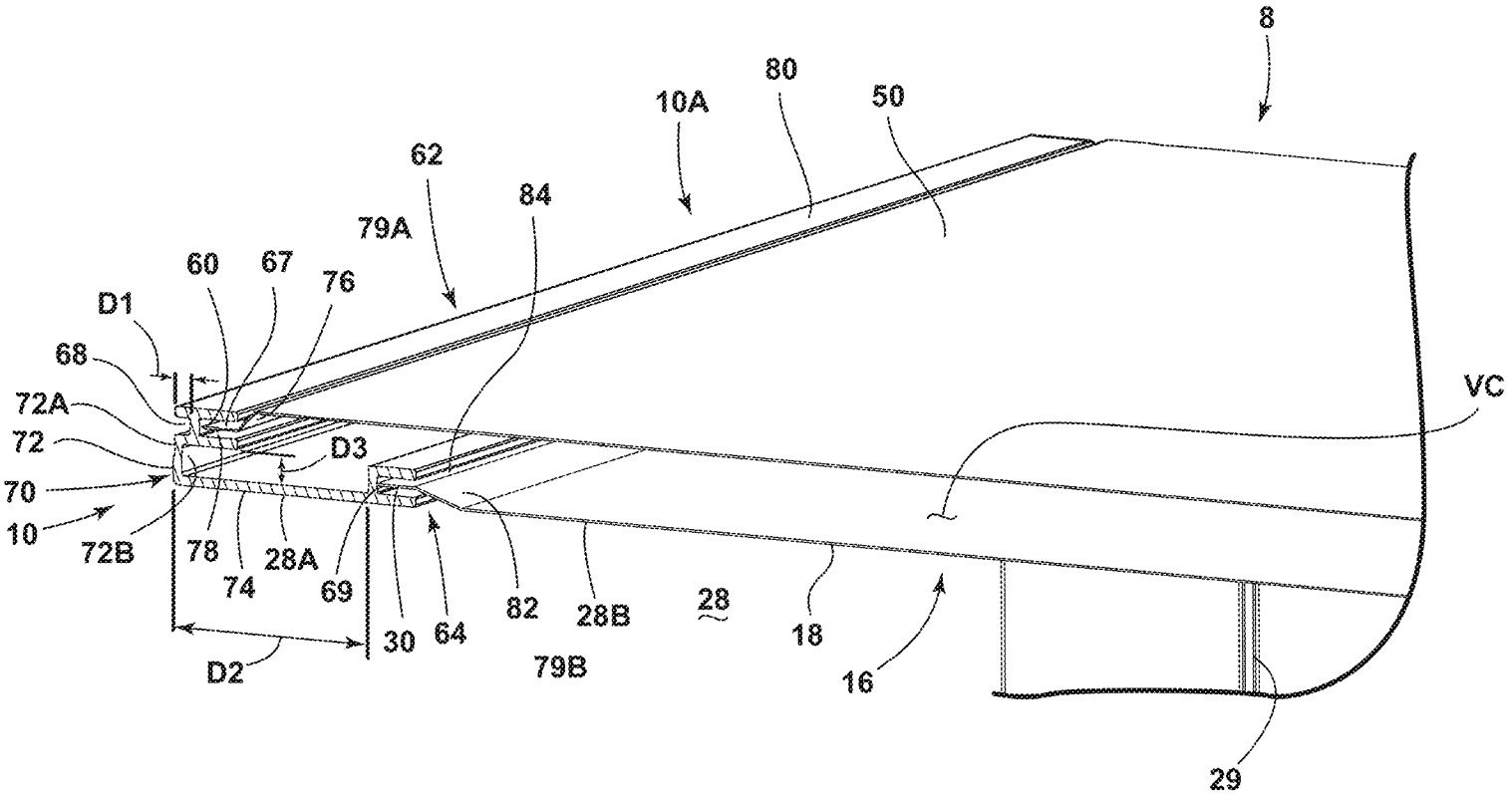
FIG. 5 is a fragmentary cross-sectional view of the thermal bridge taken from location V of FIG. 4.

Referring now to FIG. 5, the upper portion 10A of the thermal bridge 10 is shown having a body portion 70 with a front forward facing sealing surface 72 and an inwardly projecting extension 74. The front sealing surface 72 is a generally vertical forward facing sealing surface that provides a substantially planar surface for seal members of the doors, such as doors 5 and 6 shown above in FIG. 1, to seal against when closed. The inwardly projecting extension 74 of the body portion 70 of the thermal bridge 10 projects in a substantially horizontal manner at the upper portion 10A of the thermal bridge 10 and provides a substantially planar surface which defines the front portion 28A of the refrigerator compartment 28, as shown in FIG. 3. In this way, the body portion 70 of the thermal bridge 10 includes a first portion (the upright outwardly facing sealing surface 72) and a second portion (the inwardly projecting extension 74 that extends orthogonally to the upright sealing surface 72) to provide an overall L-shaped body portion 70. The inwardly projecting extension 74 is positioned around the entire upper opening 12A of the thermal bridge 10 to define the front portion 28A of the refrigerator compartment 28 from all four sides thereof. Thus, the upper opening 12A of the thermal bridge 10 defines an opening into the refrigerated compartment 28 in assembly. The inwardly projecting extension 74 extends inwardly a distance D2 as shown in FIG. 5 from the sealing surface 72. The sealing surface 72 also extends around the entire upper opening 12A of the thermal bridge 10 to define a fully encircling sealing surface 72 for the refrigerator compartment 28.

The configuration of the body portion 70 of the thermal bridge 10 provides for the outer coupling portion 62 to be disposed outside of the inner coupling portion 64. Along the upper portion 10A of the thermal bridge 10, outer coupling portion 62 is specifically disposed above of the inner coupling portion 64. The outer coupling portion 62 is positioned on a rear side 72B of the sealing surface 72 and includes a first channel 67 which opens inwardly. As shown in FIG. 5, the front edge 60 of the wrapper 8 is received in the first channel 67. In the embodiment of FIG. 5, an outwardly opening channel 68 is shown disposed on a front side 72A of the sealing surface 72. The outwardly opening channel 68 is configured to receive tubing for a heat loop, as further described below with specific reference to FIG. 8.

As further shown in FIG. 5, the inner coupling portion 64 includes a second channel 69 which, much like first channel 67, is disposed on the rear side 72A and opens inwardly. As shown in FIG. 5, the front edge 30 of the refrigerator liner 16 is received in the second channel 69 of the thermal bridge 10. Thus, the thermal bridge 10, as shown in the embodiment of FIG. 5, extends across a gap or vacuum cavity VC between the wrapper 8 and the refrigerator liner 16 to interconnect the wrapper 8 and the refrigerator liner 16. The body portion 70 of the thermal bridge 10 includes first and second channels 67, 69 which open inwardly in a first direction, and further includes a third channel, outwardly opening channel 68, which opens outwardly in a second direction that is opposed to or opposite from the first direction. The front edges 60, 30 of the wrapper 8 and the refrigerator liner 16 are disposed in the first and second channels 67, 69, respectively.

As further shown in FIG. 5, the outer coupling portion 62 is disposed along an upper portion of the sealing surface 72 of the body portion 70 of the thermal bridge 10 at the upper portion 10A of the thermal bridge 10. Thus, the outer coupling portion 62, and the channel 67 thereof, is outboard of the inner coupling portion 64, and the channel 69 thereof. Further, the inner coupling portion 64 is staggered or offset relative to the outer coupling portion 62. Specifically, in the embodiment shown in FIG. 5, the inner coupling portion 64, and the channel 69 thereof, is disposed inward and below the outer coupling portion 62, and the channel 67 thereof, as the inner coupling portion 64 is disposed on an end of the inwardly projecting extension 74 of the body portion 70 of the thermal bridge 10.

As further shown in FIG. 5, the front edge 60 of the wrapper 8 may include an angled transverse portion 76 and an end flange portion 78 that is received in the first channel 67 of the outer coupling portion 62 of the thermal bridge 10. The angle of the transverse portion 76 of the wrapper 8 allows the top wall 50 of the wrapper 8 to be flush with an outer surface 80 of the thermal bridge 10, when the end flange portion 78 is received in the first channel 67 of the outer coupling portion 62 of the thermal bridge 10. The end flange portion 78 is contemplated to be part of the front edge 60 of the wrapper 8 that is received in the first channel 67 for providing a surface for attachment of the outer coupling portion 62. This interconnection can include an adhesive or sealant medium disposed in the first channel 67 to adhere the components together in an airtight manner for retaining a vacuum between the thermal bridge 10 and the wrapper 8 and liner 16 in the vacuum insulated cavity VC. Similarly, the refrigerator liner 16 includes an angled transverse portion 82 extending off of top wall 18 thereof, and leading to an end flange portion 84 which is received in the second channel 69 of the inner coupling portion 64. The angle of transverse portion 82 of the refrigerator liner 16 allows for the inner surface of top wall 18 to align with the inwardly projecting extension 74 of the thermal bridge 10. With the front edge 30 of the refrigerator liner 16 received in the second channel 69 of the inner coupling portion 64, the end flange portion 84 provides a surface for the thermal bridge 10 to adhere to the refrigerator liner 16. This interconnection can include an adhesive or sealant medium disposed in the second channel 69 to adhere the components together in an airtight manner for retaining a vacuum between the thermal bridge 10 and the wrapper 8 and liner 16 in the vacuum insulated cavity VC. As shown in FIG. 5, the transverse portion 82 of the refrigerator liner 16 extends inwardly towards the vacuum insulated cavity VC. In this way, the transverse portion 82 of the refrigerator liner 16 extends towards the wrapper 8. Similarly, the transverse portion 76 of the wrapper 8 extends inwardly towards the vacuum insulated cavity VC in an opposed direction as compared to the angle of the transverse portion 82 of the refrigerator liner 16. In this way, the transverse portion 76 of the wrapper 8 extends towards the refrigerator liner 16. This configuration is also shown in FIG. 12C, wherein the external wrapper 122 and the inner liner 118 include transverse portions extending into the gap 126 disposed between the external wrapper 122 and the inner liner 118.

As further shown in FIG. 5, the end flange portion 78 of the wrapper 8 extends outwardly in a direction as indicated by arrow 79A. The direction indicated by arrow 79A of the end flange portion 78 of the wrapper 8 is parallel the top wall 50 of the wrapper 8. Thus, the end flange portion 78 of the wrapper 8 extends outwardly in a straight line from the angled transverse portion 76 of the wrapper 8. Similarly, the end flange portion 84 of the refrigerator liner 16 extends outwardly in a direction as indicated by arrow 79B. The direction indicated by arrow 79B of the end flange portion 84 of the refrigerator liner 16 is parallel the top wall 18 of the refrigerator liner 16. Thus, the end flange portion 84 of the refrigerator liner 16 extends outwardly in a straight line from the angled transverse portion 82 of the refrigerator liner 16. It is contemplated that the configuration of the end flange portions 78, 84 of the wrapper 8 and refrigerator liner 16 being parallel to the top walls 50, 18 thereof is a common configuration along all walls of the wrapper 8 and refrigerator liner 16 around the openings 61, 31 thereof. This configuration is also shown in FIG. 12C, wherein the external wrapper 122 and the inner liner 118 include end flange portions extending outwardly in a straight and parallel manner with respect to the associated walls of the external wrapper 122 and the inner liner 118 shown in FIG. 12C.

Thus, in the configuration of the thermal bridge 10 shown in FIG. 5, the front edge 60 of the wrapper 8 is not only spaced-apart from the front edge 30 of the refrigerator liner 16 so as to be outside of or outboard from the front edge 30 of the refrigerator liner 16 (as indicated by arrow D3), but is also offset laterally from the front edge 30 of the refrigerator liner 16 (as indicated by arrow D2). This is generally due to the thermal bridge 10 having a staggered configuration for outer coupling portion 62 (and first channel 67 thereof) relative to the inner coupling portion 64 (and the second channel 69 thereof) for receiving the front edge 60 of the wrapper 8 and the front edge 30 of the refrigerator liner 16, respectively. The first channel 67 is inset from the sealing surface a distance D1 and is outboard of the second channel 69 a distance D3. The second channel 69 is inset from the sealing surface a distance D2, which, as noted above is greater than the distance D1 defined between the sealing surface 72 and the first channel 67. This staggered configuration is also present between the wrapper 8 and the freezer liner 32, as further described below. Thus, the thermal bridge 10 includes a first portion defined by the sealing surface 72 with a first channel 67 disposed thereon. The thermal bridge 10 further includes a second portion defined by the inwardly projecting extension 74 which inwardly extends from the sealing surface 72 and includes a second channel 69 disposed at a distal end thereof. The first and second channels 67, 69 are vertically and horizontally offset from one another such that the staggered configuration of the channels 67, 69 is provided for around the entire upper opening 12A of the thermal bridge 10.

The distances indicated in FIG. 5 may include specific parameters in the ranges noted below. However, the scope of the present concept is not limited to such ranges. For example, the outer surface 72A of the sealing surface 72 may be approximately 20 mm to provide a substantial surface for doors to seal against. The distance D3 measuring the offset between the first channel 67 and the second channel 69 may be approximately 12 mm. The distance D2 may be approximately 70 mm, such that the inwardly projecting extension 74 provides a substantial polymeric front portion 28A for the refrigerator compartment 28. Further, the first channel 67 and the second channel 69 may be spaced-apart about 57 mm from one another in a direct path measured therebetween.

Figure 6:
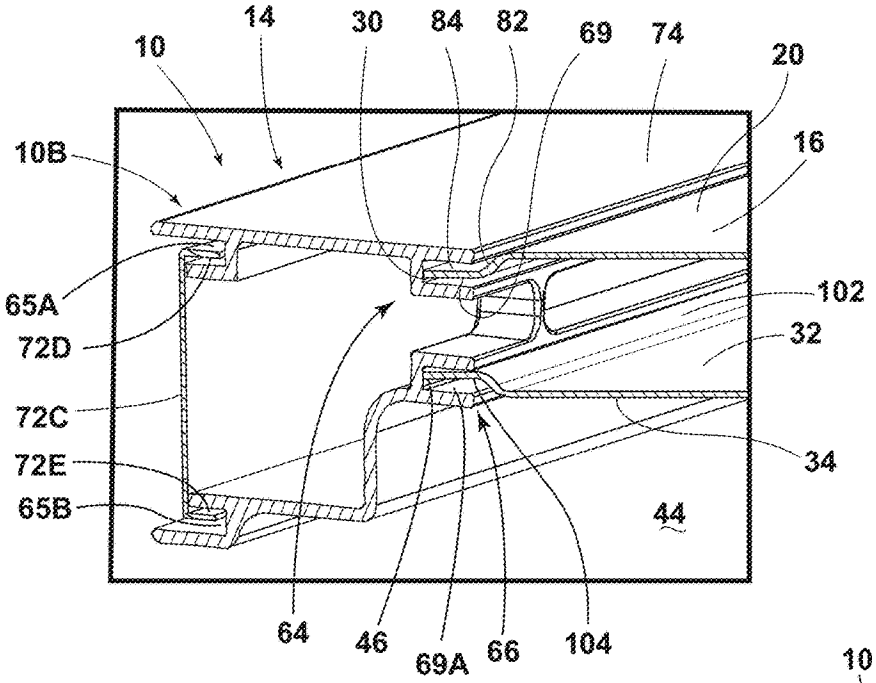
FIG. 6 is a fragmentary cross-sectional view of the thermal bridge taken from location VI of FIG. 4.

Referring now to FIG. 6, the middle portion 10B of the thermal bridge 10 is shown having inner coupling portion 64 disposed above inner coupling portion 66. As noted above, the inner coupling portion 64 is configured to receive the front edge 30 of the refrigerator liner 16 at channel 69 thereof, as shown in FIG. 6. As further noted above, the inner coupling portion 66 is configured to receive the front edge 46 of the freezer liner 32 at channel 69A thereof, as shown in FIG. 6. The inner coupling portion 66 is interconnected with the inner coupling portion 64 by a trim component 72C that may be a detachable trim component to the thermal bridge 10 that is used to seal lower portions of doors (such as doors 5 and 6 shown in FIG. 1) and an upper portion of a drawer (such as drawer 7 shown in FIG. 1) to the thermal bridge 10. At the middle portion 10B, the thermal bridge 10 includes an upper outwardly opening channel 65A and a lower outwardly opening channel 65B. The trim component 72C includes inwardly turned upper and lower legs 72D and 72E that are received in the upper outwardly opening channel 65A and the lower outwardly opening channel 65B, respectively.

As further shown in FIG. 6, the inner coupling portion 64 is disposed above the inner coupling portion 66. Further, the inner coupling portion 64 is not staggered or offset relative to the inner coupling portion 66, but rather they are aligned with one another. In the embodiment shown in FIG. 6, the refrigerator liner 16 includes the transverse portion 82 extending off of bottom wall 20 thereof, and leading to the end flange portion 84 which is received in the second channel 69 of the inner coupling portion 64. Thus, the transverse portion 82 of the refrigerator liner 16 is disposed all the way around the opening 31 of the refrigerator liner 16 at top wall 18, bottom wall 20 and opposed side walls 22, 24 at front portions thereof. The end flange portion 84 is also disposed fully around the refrigerator liner 16 extending outwardly from transverse portion 82, and defining a surface for adhering engagement with the second channel 69 of the inner coupling portion 64 of the thermal bridge 10.

Similarly, the freezer liner 32 includes a transverse portion 92 extending off of top wall 34 thereof, and leading to an end flange portion 94 which is received in the inner coupling portion 66. Like the refrigerator liner 16, the transverse portion 92 of the freezer liner 32 is disposed all the way around the opening 47 of the freezer liner 32 at top wall 34, bottom wall 36 and opposed side walls 38, 40 at front portions thereof. The end flange portion 94 is also disposed fully around the freezer liner 32 extending outwardly from transverse portion 92, and defining a surface for adhering engagement with the channel 69A the inner coupling portion 64 of the thermal bridge 10.

Figure 7:
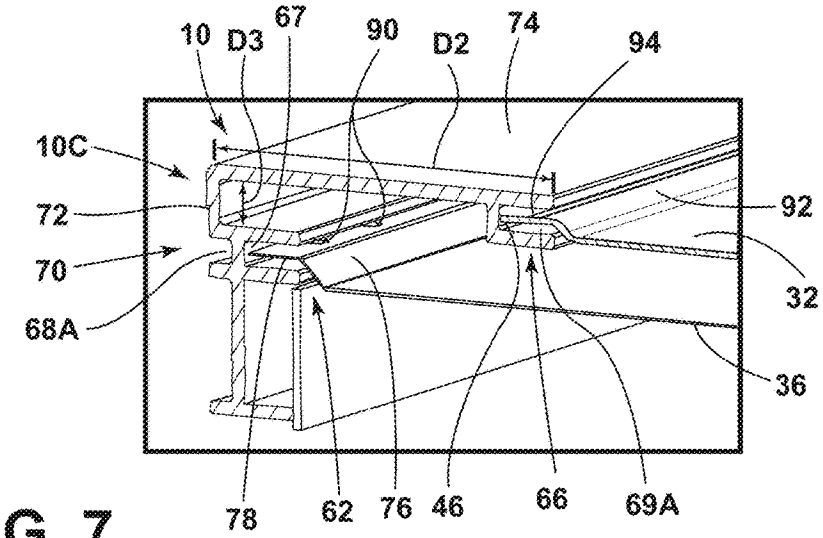
FIG. 7 is cross-sectional view of the thermal bridge taken from location VII of FIG. 4.

Referring now to FIG. 7, the lower portion 10C of the thermal bridge 10 is shown having the outer coupling portion 62 disposed below the inner coupling portion 66. The outer coupling portion 62 is interconnected with the inner coupling portion 66 by the body portion 70 having the upright portion 72 and the horizontal portion 74. As shown in FIG. 7, the inner coupling portion 66 is staggered or offset relative to the outer coupling portion 62 by the distances indicated by arrows D2 and D3. Specifically, in the embodiment shown in FIG. 7, the inner coupling portion 66 is disposed inward and above the outer coupling portion 62 as disposed on an end of the inwardly projecting extension 74 of the body portion 70 of the thermal bridge 10. Thus, the staggered configuration of the outer coupling portion 62 and the inner coupling portion 66 is akin to the staggered configuration of the outer coupling portion 62 and the inner coupling portion 64 shown in FIG. 5. In this way, the front edge 60 of the wrapper 8 is not only spaced-apart from the front edge 46 of the freezer liner 32 so as to be outside of the front edge 46 of the freezer liner 32, but is also offset laterally outward from the front edge 46 of the freezer liner 32. Similarly, the thermal bridge 10 includes a staggered configuration for outer coupling portion 62 relative to the inner coupling portion 66 for receiving the front edge 60 of the wrapper 8 and the front edge 46 of the freezer liner 32.

Thus, as shown in FIGS. 5-7, the end flange portions 84 and 94 of the refrigerator liner 16 and the freezer liner 32, respectively, are disposed inwardly of the end flange portion 78 of the wrapper 8 given the inwardly projecting extension 74 of the thermal bridge 10. All of the end flange portions 78, 84 and 94 include inner and outer surfaces which may include a plurality of engagement features, such as engagement features 90 shown in FIG. 7 disposed on end flange portion 78 of the wrapper 8. The engagement features 90 shown in FIG. 7 are contemplated to be outwardly extending dimples and may be disposed on both sides of a front edge, such as front edge 84 of the refrigerator liner 16 shown in FIG. 9. The dimples may also be positioned on the inner contours of the channels 67 and 69A as well. Having such undulations positioned on the opposed contact surfaces of the end flange portions 78, 84 and 94 provides for better engagement between the wrapper 8, the liners 16, 32, and the thermal bridge 10 to ensure that a vacuum can be drawn and maintained in the vacuum cavity VC between the wrapper 8, the liners 16, 32, and the thermal bridge 10. The engagement features 90 also provide centering features for the front edges 78, 84 and 94 of the wrapper 8, the refrigerator liner 16 and the freezer liner 32, to center the edges 78, 84 and 94 within the channels 67, 69 and 69A.

Figure 8:
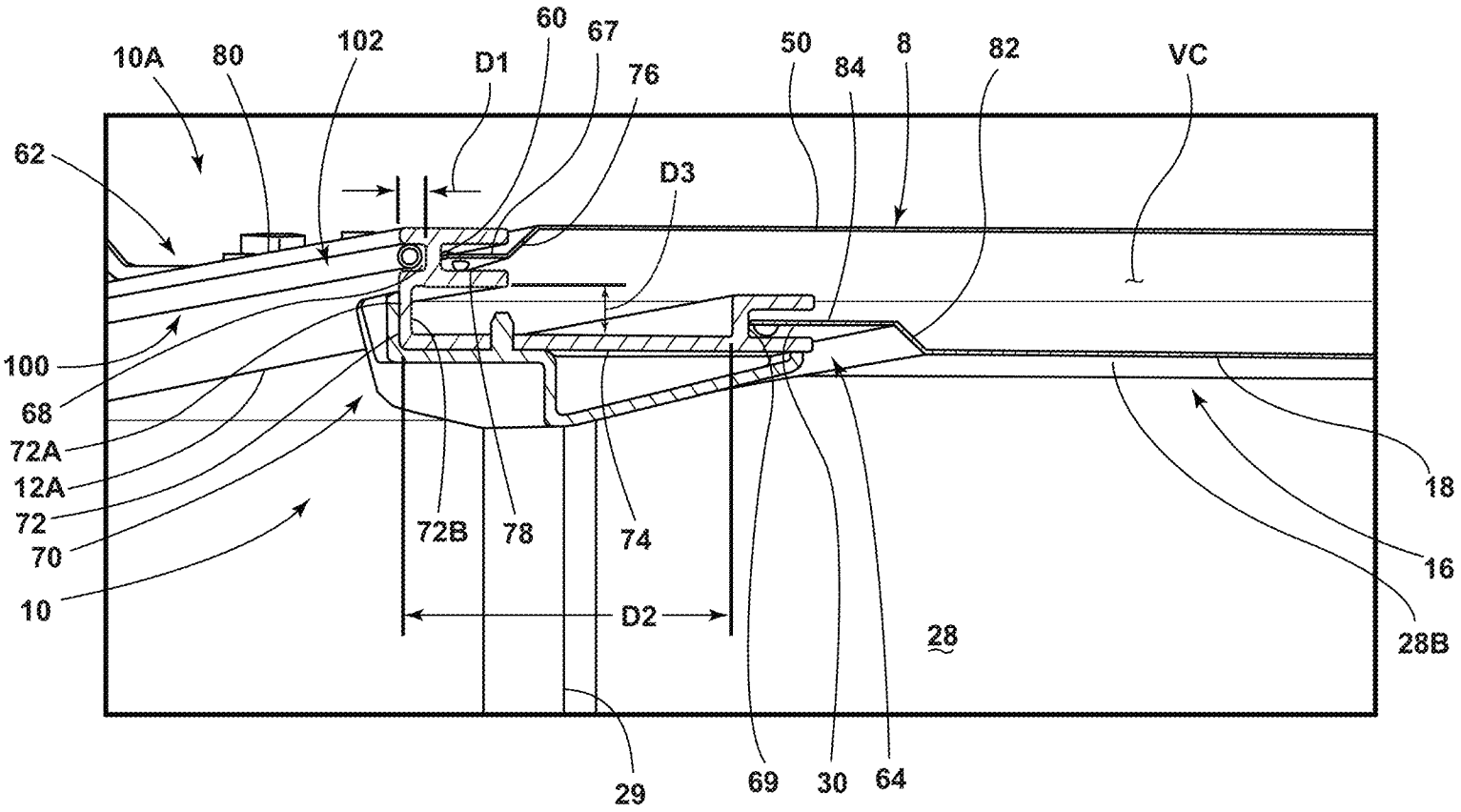
FIG. 8 is a fragmentary cross-sectional view of the thermal bridge of FIG. 5 having a portion of a conduit coupled thereto.
Figure 11:
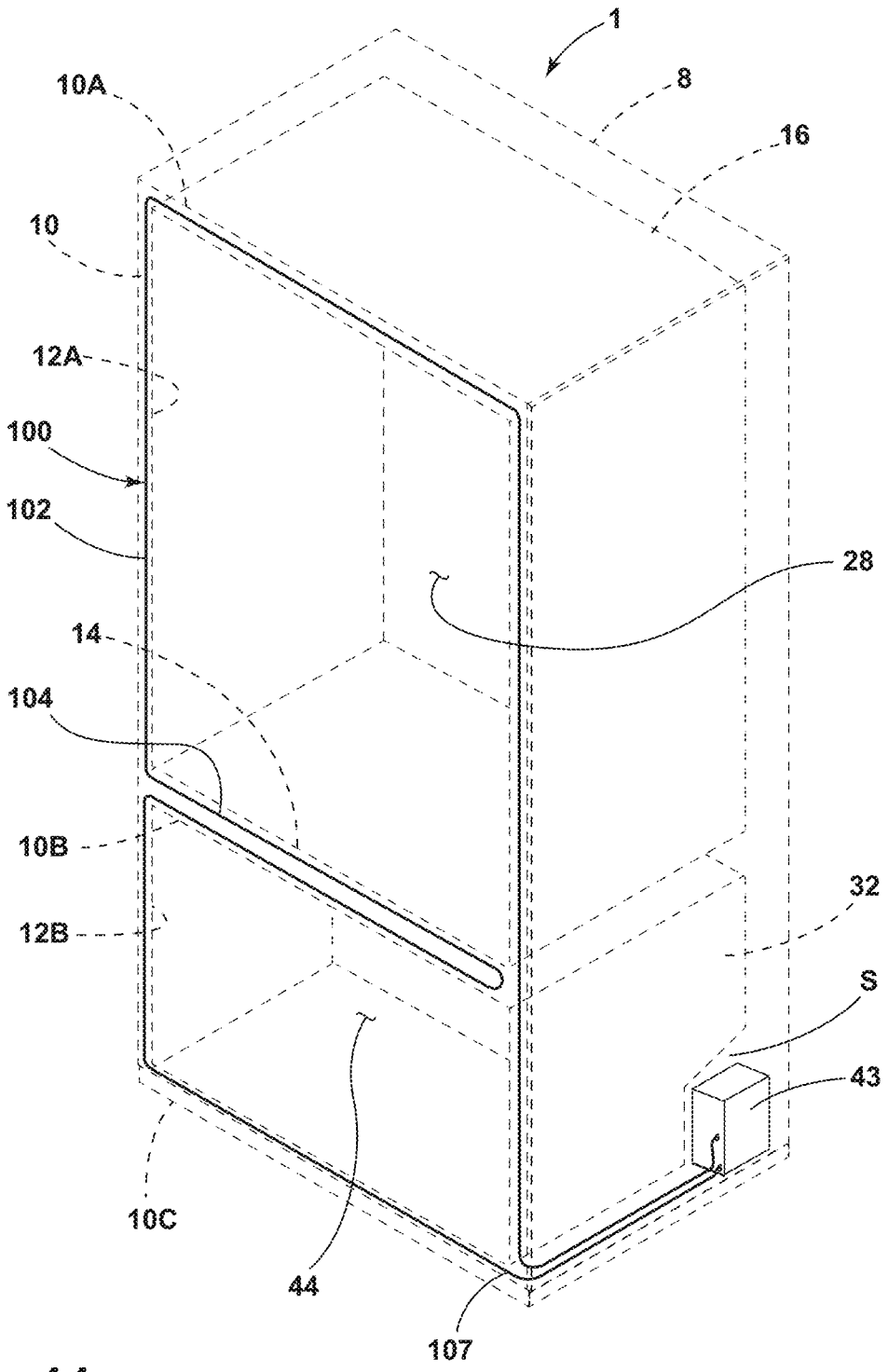
FIG. 11 is a top perspective view of the vacuum insulated cabinet structure of FIG. 3 with portions thereof shown in phantom to reveal a conduit loop.

Referring now to FIG. 8, the thermal bridge 10 is shown along the upper portion 10A thereof. In the outwardly opening channel 68 disposed along the sealing surface 72 of the thermal bridge 10, a conduit 100 is shown positioned therein. The conduit 100 comprises a continuous loop of tubing 102 that is routed through the refrigerator 1 (FIG. 1) as best shown in FIG. 11. The conduit 100 may be referred to as a heat loop, a Yoder loop or a condenser loop, but is not meant to be limited to any one shape or configuration by the term "loop." The conduit 100 circulates, or otherwise transports, a heated medium, such as heated refrigerant that is generated by the mechanical equipment 43 (FIGS. 4 and 11) when the mechanical equipment 43 is cooling the compartments 28 and 44. The heated refrigerant contained and transported through the tubing 102 of the conduit 100 provides for an "anti-sweat" feature to help prevent condensation that can develop when the cold surfaces of the compartments 28 and 44 are exposed to ambient air in which the refrigerator 1 is disposed. This warm and humid air can cause condensation to develop along the sealing surface 72 of the thermal bridge 10. The circulating warmed refrigerant of the conduit 100 provides a mitigating factor for combatting condensation buildup at the sealing surface 72.

As specifically shown in FIG. 8, the conduit 100 is positioned in the outwardly opening channel 68 which is configured to extend around an entire perimeter of the refrigerator 1, as best shown in FIG. 11. The conduit 100 can be retained in the outwardly opening channel 68 using an adhesive material. The placement of the conduit 100 in the outwardly opening channel 68 is provided, such that the conduit 100 can circulate heated refrigerant near the opening 12A into the refrigerator compartment 28. It is contemplated that the outwardly opening channel 68 and the conduit 100 thereof are positioned about 12 mm from the opening 12A into the refrigerator compartment 28. However, the scope of the present concept is not limited to such an embodiment.

Figure 9:
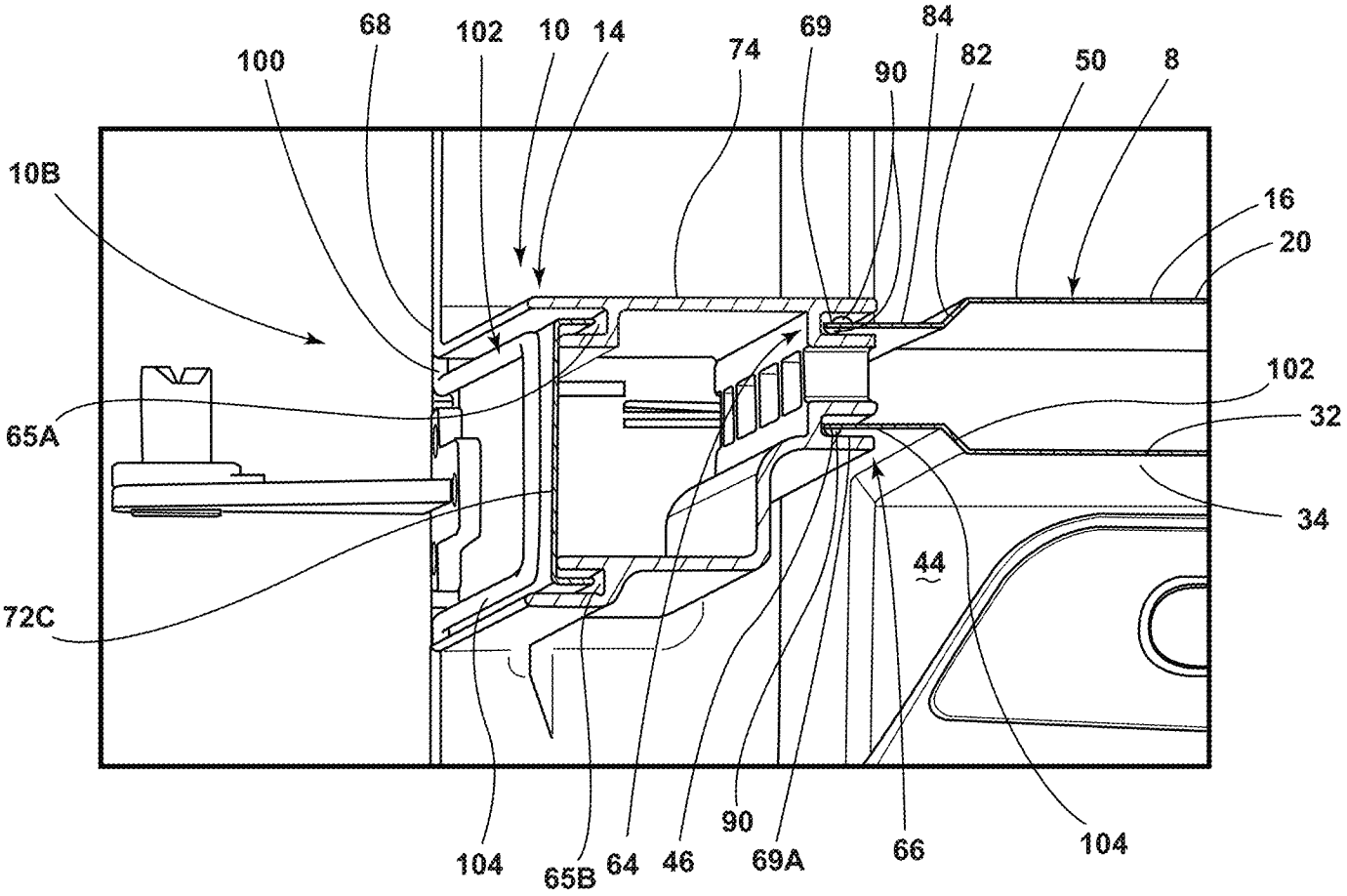
FIG. 9 is a fragmentary cross-sectional view of the thermal bridge of FIG. 6 having a portion of a conduit coupled thereto.

Referring now to FIG. 9, the conduit 100 is positioned in the outwardly opening channel 68 along the side of the refrigerator 1. An intermediate portion 104 of the tubing 102 of the conduit 100 loops through the mullion portion 14 of the thermal bridge 10 along trim piece 72C which is connected to the upper and lower outwardly opening channels 65A, 65B. With the portion 104 of the conduit 100 extending across the mullion portion 14, the openings 12A, 12B of the thermal bridge 10 are fully surrounded by the conduit 100, as best shown in FIG. 11.

Figure 10:
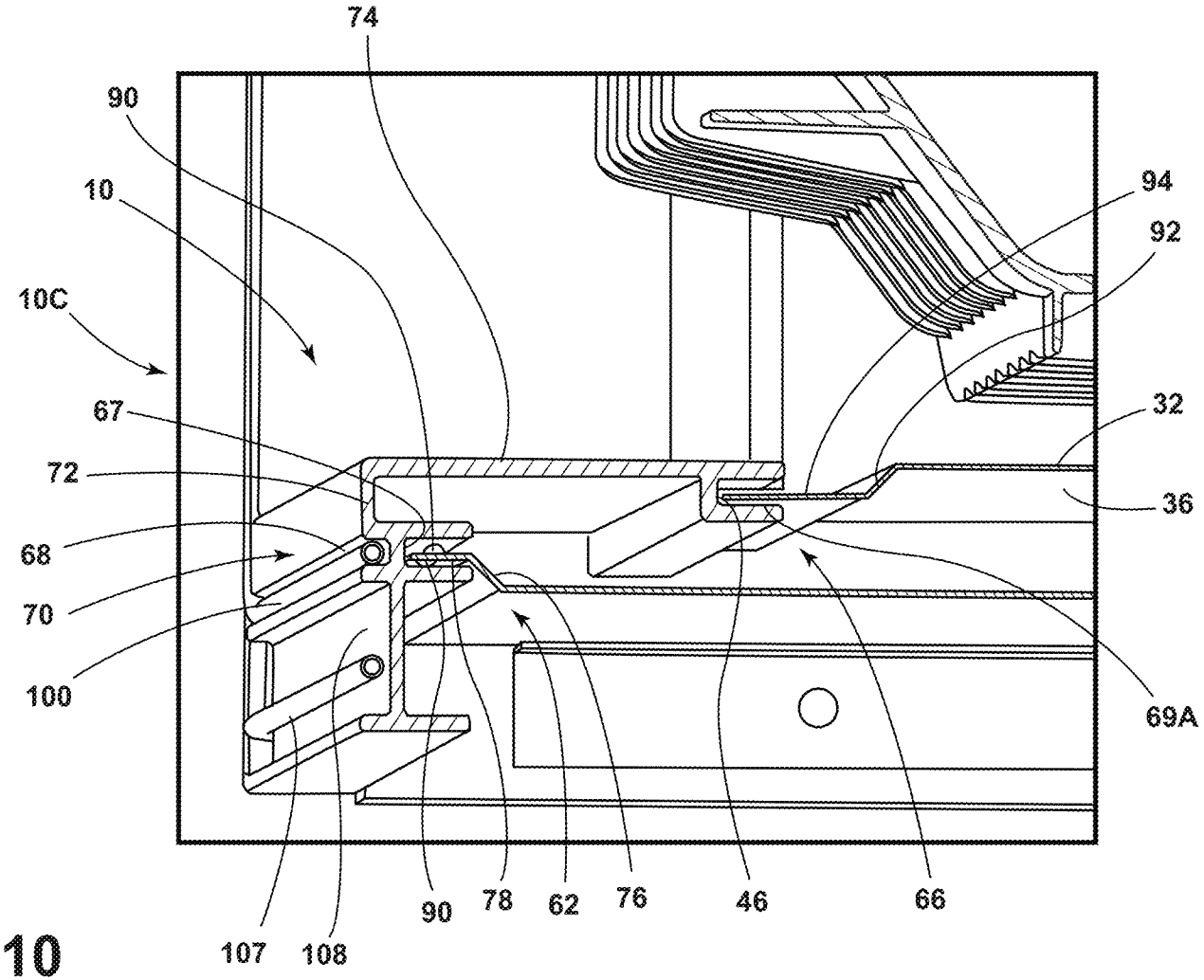
FIG. 10 is a is a fragmentary cross-sectional view of the thermal bridge of FIG. 7 having a portion of a conduit coupled thereto.

Referring now to FIG. 10, the conduit 100 is positioned in the outwardly opening channel 68 which, as noted above, is configured to extend around an entire perimeter of the refrigerator 1, as best shown in FIG. 11. The conduit 100 is also shown having a return portion 107 positioned in a raceway 108 formed in the lower portion 10C of the thermal bridge 10. The return portion 107 is contemplated to run the conduit 100 back to the spacing S of the refrigerator 1 where the cooling equipment 43 is housed, as best shown in FIG. 11.

Referring now to FIG. 11, the conduit 100 is positioned in the outwardly opening channel 68 (see FIGS. 8-10) of the thermal bridge 10 around the entirety of the refrigerator 1. The intermediate portion 104 of the tubing 102 of the conduit 100 is shown covering the mullion portion 14 of the thermal bridge 10. Thus, the conduit 100 fully surrounds the openings 12A and 12B of the thermal bridge 10 which open into the refrigerator compartment 28 and the freezer compartment 44, respectively. Further, the return portion 107 is illustrated as running the conduit 100 back to the spacing S of the refrigerator 1 where the cooling equipment 43, that generates the heated refrigerant for circulation within the conduit 100, is housed.

Referring to FIGS. 12A-15B, a refrigerator 110 includes a cabinet 114 having an inner liner 118 and an external wrapper 122. The inner liner 118 is positioned within the external wrapper 122 such that a gap 126 is defined between the external wrapper 122 and internal liner 118. A first insulator 130 is positioned within the gap 126 and a second insulator 134 is positioned within the gap 126. A pressure within the gap 126 may be below about 1000 Pa.

Figure 12A:
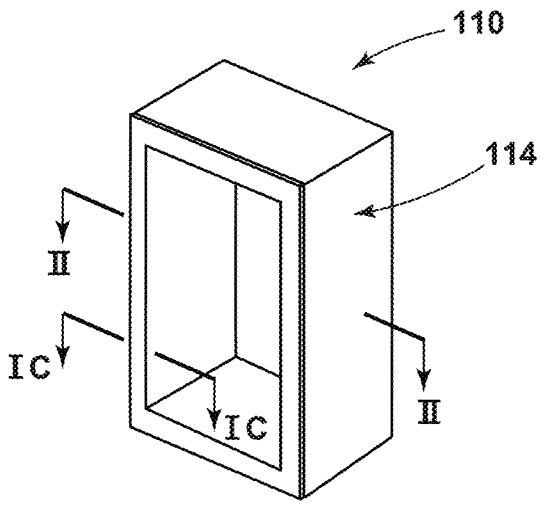
FIG. 12A is a top perspective view of a refrigerator cabinet, according to one embodiment.
Figure 12B:
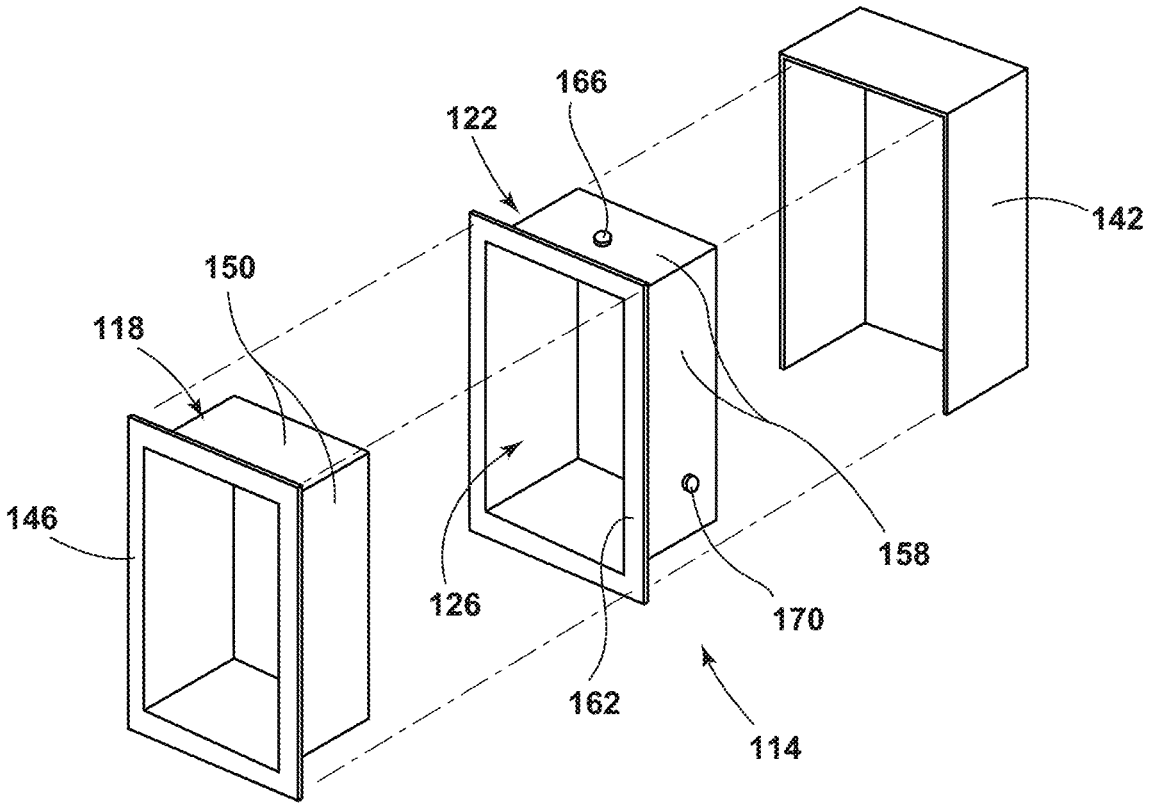
FIG. 12B is an exploded top perspective view of the refrigerator cabinet of FIG. 12A, according to one embodiment.
Figure 12C:
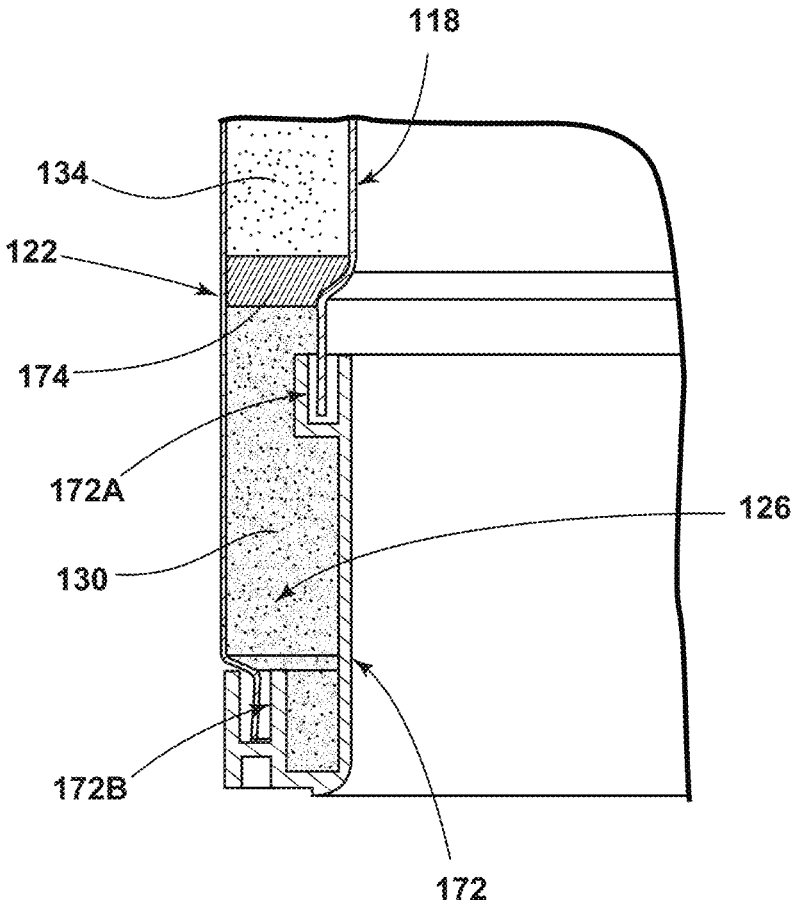
FIG. 12C is a cross-sectional view taken at line IC-IC of FIG. 12A, according to one embodiment.

Referring now to FIGS. 12A and 12B, the refrigerator 110 includes the cabinet 114. The refrigerator 110 may take a variety of configurations including French door, side by side, top freezer, bottom freezer, counter depth, compact, built-in, and other types of refrigerators. The cabinet 114 includes the inner liner 118, the external wrapper 122 and may optionally include a shell 142. In the depicted embodiment, the inner liner 118 has a generally rectangular box shape, but may take a variety of shapes including a cube, prism, parallelepiped, etc. and combinations thereof. The inner liner 118 may have a liner flange 146 disposed around the inner liner 118 and connected to a plurality of liner walls 150 which define the inner liner 118. The inner liner 118 may be formed from a polymeric material having high barrier properties (e.g., low gas permeation), metals and combinations thereof. The inner liner 118 may be formed via thermoforming, injection molding, bending and/or forming. The liner walls 150 of the inner liner 118 may have a thickness ranging from between about 0.1 mm to about 3.0 mm. In a specific embodiment, the liner walls 150 have a thickness of about 0.5 mm.

The inner liner 118 is shaped and configured to mate, couple or otherwise be positioned within the external wrapper 122. The external wrapper 122 includes a plurality of wrapper walls 158 to which a wrapper flange 162 is coupled. The wrapper flange 162 and the liner flange 146 are configured to be coupled when the cabinet 114 is in an assembled configuration. The coupling of the liner flange 146 and the wrapper flange 162 may be performed such that an airtight, or hermetic, seal is formed between the inner liner 118 and the external wrapper 122. The hermetic seal of the wrapper flange 162 and the liner flange 146 may be achieved through use of adhesives, welding, an elastomeric gasket under compression and/or crimping. The coupling of the liner flange 146 to the wrapper flange 162 may be performed proximate a front flange area 164 (FIG. 13A) of the cabinet 114. The front flange area 164 may be configured to couple with a door which permits access to an interior of the cabinet 114.

The external wrapper 122 may be formed of and by any of the materials and processes listed above in connection with the inner liner 118. The wrapper walls 158 of the external wrapper 122 may have a thickness ranging from between about 0.1 mm to about 3.0 mm. In a specific embodiment, the wrapper walls 158 have a thickness of about 0.5 mm. The wrapper walls 158 of the external wrapper 122 may define an injection port 166 and/or a vacuum port 170. The external wrapper 122 may include one or multiple injection ports 166 and/or vacuum ports 170. The injection ports 166 and/or vacuum ports 170 may be positioned as illustrated or in a variety of positions about the external wrapper 122. It will be understood that in alternative embodiments, the injection ports 166 and/or vacuum ports 170 may be disposed on both the external wrapper 122 and inner liner 118, or solely on the inner liner 118. The injection port 166 and the vacuum port 170 may be used to access (e.g., to inject an insulator, draw a vacuum and/or perform maintenance within) the gap 126 once the inner liner 118 and the external wrapper 122 are bonded. The injection port 166 and the vacuum port 170 may have a diameter of between about 10 mm and about 50 mm, or between about 12.5 mm and about 25 mm. In various embodiments, the injection port 166 and the vacuum port 170 may have different diameters than one another. Similarly, in embodiments utilizing more than one injection port 166 and vacuum port 170, the sizes of the injection ports 166 and the vacuum ports 170 may vary.

Referring now to FIG. 12C, the inner liner 118 and the external wrapper 122 may be joined via a trim breaker 172. The trim breaker 172 may be formed of a plastic, a metal, a composite and/or insulating materials. The trim breaker 172 may define a liner joint 172A configured to couple the inner liner 118 to the trim breaker 172. The trim breaker 172 may also define a wrapper joint 172B configured to couple the external wrapper 122 to the trim breaker 172. The liner joint 172A and the wrapper joint 172B may be vibration welded, crimped, thermally bonded, adhesively bonded or otherwise coupled to render the gap 126 airtight. The trim breaker 172 may be used to hold the inner liner 118 and the external wrapper 122 together and in place. Use of the trim breaker 172 may provide advantages of resisting thermal bridging between the inner liner 118 and the external wrapper 122 and easing manufacturing.

Figure 13A:
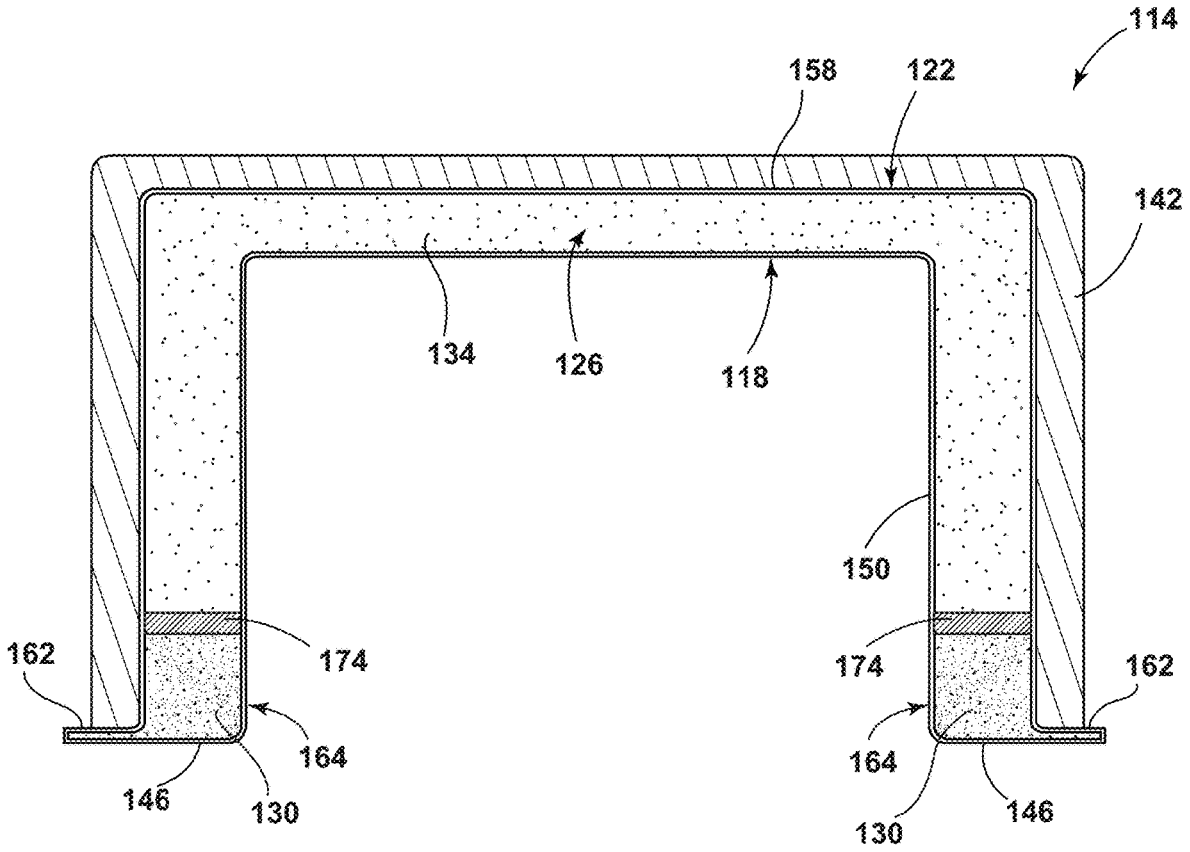
FIG. 13A is a cross-sectional view taken at line II-II of FIG. 12A, according to one embodiment.

Referring now to FIG. 13A, once the inner liner 118 and the external wrapper 122 have been joined and the gap 126 defined, the first insulator 130 and the second insulator 134 may be dispensed into the gap 126. The gap 126 may have a thickness of between about 12 mm to about 30 mm. The gap 126 may have an air pressure of less than about 1 atm (101,325 Pa, 1013.25 mbar), less than about 0.5 atm (50,662.5 Pa, 506.63 mbar), less than about 0.1 atm (10,132.5 Pa, 101.33 mbar), less than about 0.001 atm (101.325 Pa, 1.0133 mbar) or less than about 0.00001 atm (1.01 Pa, 0.01 mbar). Over the service life of the refrigerator 110 (FIG. 12A), the air pressure within the gap 126 may rise more than about 0.001 atm (101 Pa, 1.01 mbar), greater than about 0.005 atm (506 Pa, 5.06 mbar) or greater than about 0.01 atm (1,013 Pa, 10.13 mbar) due to diffusion and/or permeation of gases into the gap 126 through the inner liner 118 and/or the external wrapper 122. The first and second insulators 130, 134 may be a material configured to have low thermal conductivity. For example, the first and second insulators 130, 134 may include precipitated silica, polyurethane foam, fumed silica, silica fume, beads (e.g., of glass, ceramic, and/or an insulative polymer), hollow organic micro/nano spheres, hollow inorganic micro/nano spheres, silica aerogel, nano-aerogel powder, rice husk ash, diatomaceous earth, cenospheres, perlite, glass fibers, polyisocyanurate, urea foam, rice hulls, polyethylene foam, vermiculite, fiberglass and combinations thereof. Optionally, an opacifier (e.g., TiO2, SiC and/or carbon black) may be included in the first and/or second insulators 130, 134. Additionally or alternatively, materials configured to change the radiation conduction, flow properties and packing factor of the first and second insulators 130, 134 may be introduced. Further, one or more gas (e.g., oxygen, hydrogen, carbon dioxide) and/or moisture getters may be included in the first and second insulators 130, 134. The first and second insulators 130, 134 may include the same insulating material as one another, may be substantially the same material, or may be completely different materials.

In embodiments where the first and/or second insulators 130, 134 include organic spheres, the organic spheres may include polystyrene, polythiophenes, polyethylene, rubber and/or combinations thereof. In embodiments where the first and/or second insulators 130, 134 include inorganic spheres, the spheres may include glasses, ceramics and combinations thereof. In embodiments where the first and/or second insulators 130, 134 include beads or spheres, the beads or spheres may have an average outer diameter ranging from about 50 nm to about 300μ, or from about 1μ to about 300μ, or from about 50 nm to about 1000 nm. In various embodiments, the diameter size distribution of the spheres is low. Sphere embodiments of the first and/or second insulators 130, 134 may be filled with a single gas (e.g., H2, O2, N2, noble gases, volatile organic compounds, CO2, SO, SO2) or a mixture of gases (e.g., atmosphere, noble gases, O2, SO2, SO). The spheres may be sealed and have a gas pressure within the spheres of between about 0.1 atm and about 1.0 atm, or between about 0.2 atm and about 0.5 atm, or between about 0.25 atm and about 0.35 atm. The first and/or second insulators 130, 134 are positioned within the gap 126 and in contact with both the wrapper walls 158 and the liner walls 150. The packing factor of the first and/or second insulators 130, 134 within the gap 126 may be greater than about 60%, greater than about 62%, greater than about 65%, or greater than about 70%.

In embodiments where the first and/or second insulators 130, 134 include fumed silica, the fumed silica may be hydrophobic and/or hydrophilic. The fumed silica may have a particle size ranging from less than about 0.005μ to greater than about 1.0μ. The fumed silica may have a density of between about 32 kg/m3 to about 80 kg/m3. When positioned within the gap 126, the fumed silica may have a density between about 50 kg/m3 to about 300 kg/m3, or between about 80 kg/m3 to about 250 kg/m3 or between about 150 kg/m3 to about 200 kg/m3.

The first and second insulators 130, 134 are configured not only to thermally insulate the inner liner 118 from the external wrapper 122, but also to resist the inward directed force of the atmosphere on the lower than atmosphere pressure of the gap 126. Atmospheric pressure on the inner liner 118 and the external wrapper 122 may cause distortions which are unsightly and may lead to a rupture in either of the inner liner 118 or the external wrapper 122 thereby causing a loss of vacuum in the gap 126. Further, drawing the vacuum in the gap 126 may cause an impact or shock loading of the first and second insulators 130, 134 as the inner liner 118 and the external wrapper 122 contract around the first and second insulators 130, 134. Accordingly, the first and second insulators 130, 134 should have sufficient crush resistance to resist deformation of the inner liner 118 and the external wrapper 122 due to a pressure gradient between the atmosphere and an air pressure of the gap 126.

The first insulator 130 may be positioned within, and proximate to, the front flange area 164 of the cabinet 114 and the second insulator 134 may fill the rest of the gap 126. In the depicted embodiment, a filter 174 is positioned between the first insulator 130 and the second insulator 134. The filter 174 may be made of paper, a polymeric material, a ceramic and/or a metal. The filter 174 may be porous, solid and/or coupled to the inner liner 118 and/or the external wrapper 122. Use of the filter 174 may resist or prevent the migration and mixing of the first and second insulators 130, 134 such that the first and second insulators 130, 134 remain segregated. The front flange area 164, due to its thinner cross section and being surrounded by atmosphere on three sides, may suffer from a thermal, or heat, bridging effect. Such a thermal bridging across the front flange area 164 may result in an overall reduced efficiency of the refrigerator 110. Accordingly, in various embodiments the first insulator 130 may have a higher insulating property than the second insulator 134. In such an embodiment, the higher insulating property of the first insulator 130 may be sufficient to reduce, or eliminate any thermal bridging taking place through the front flange area 164.

Figure 13B:
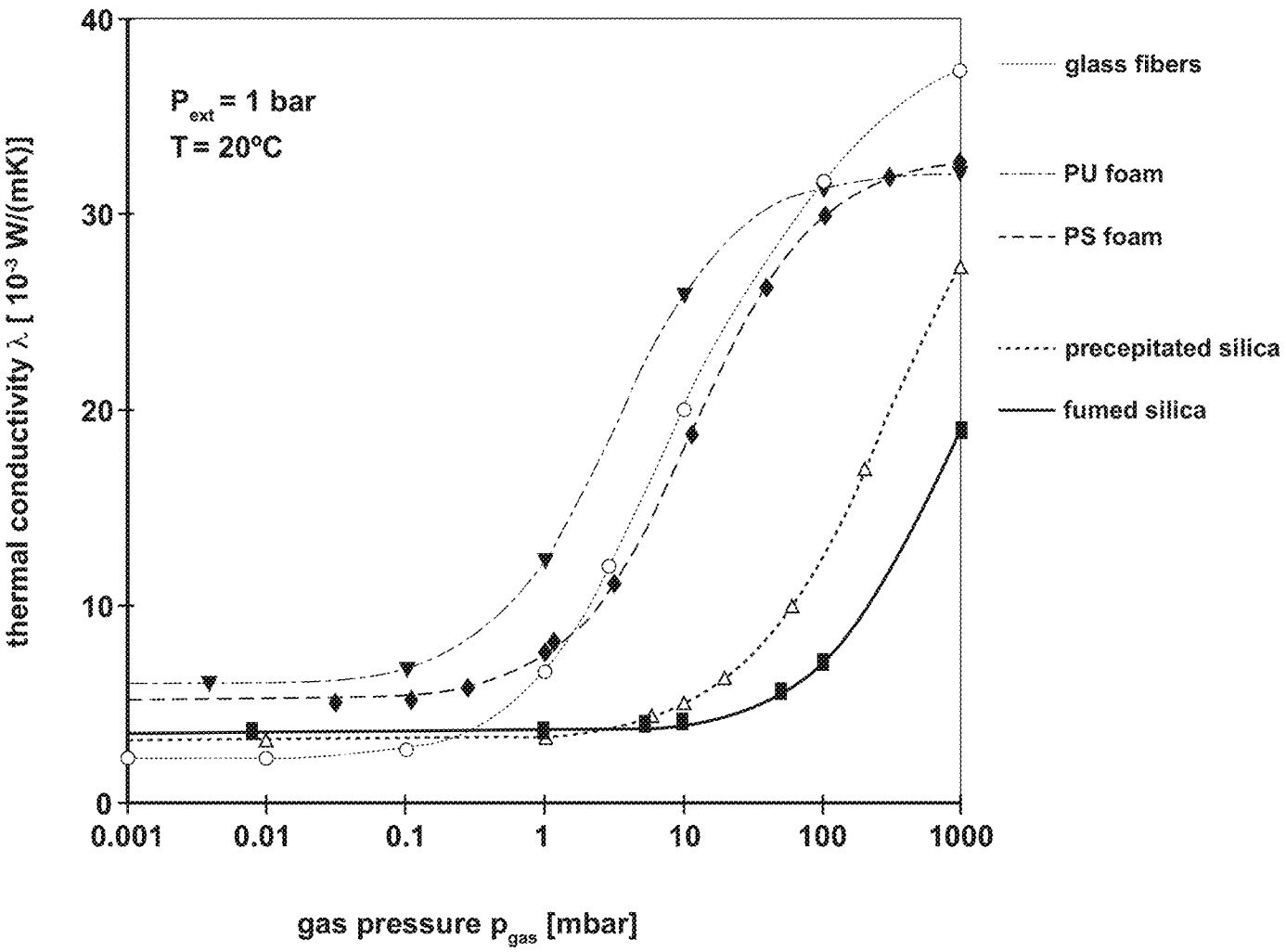
FIG. 13B is a graph depicting the thermal conductivity of various insulator materials as a function of gas pressure.

Referring now to FIGS. 13A and 13B, as explained above, the gap 126 within the cabinet 114 may undergo a pressure increase over the service life of the refrigerator 110 due to permeation and/or diffusion of gases. As such, selection of the first and second insulators 130, 134 may account for the expected change in pressure within the gap 126. As can be seen in FIG. 13B, fumed silica undergoes the smallest increase in thermal conductivity over an expected pressure change range (e.g., between about 1 mbar and about 10 mbar), followed by precipitated silica. As such, use of fumed silica as the first insulator 130 and precipitated silica and/or combinations of insulators (e.g., precipitated silica and spheres) as the second insulator 134 may not only reduce thermal bridging across the front flange area 164 while the gap 126 is at manufactured pressure, but also over the service life of the refrigerator 110.

Figure 14A:
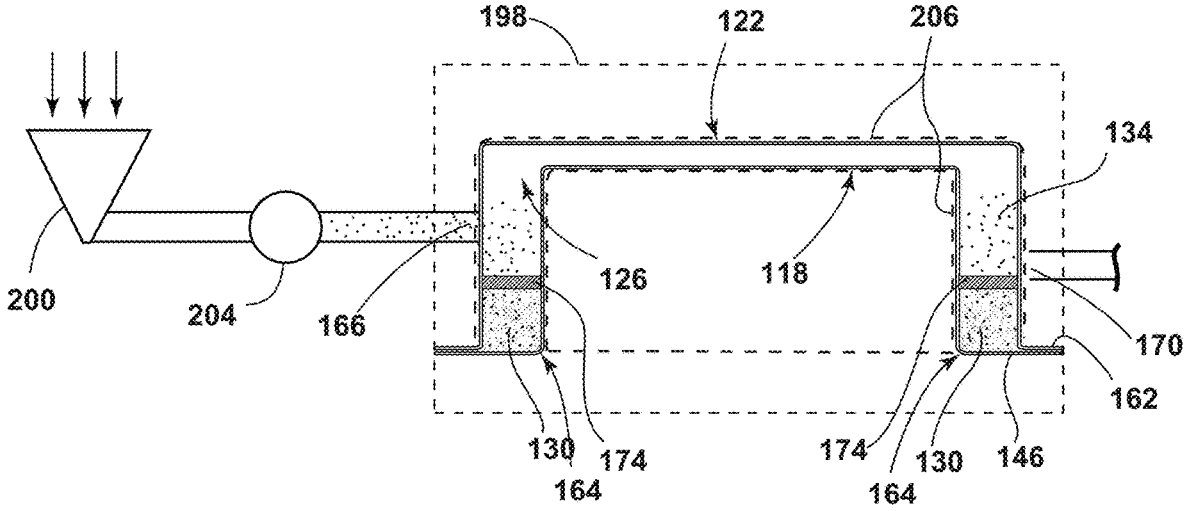
FIG. 14A is a schematic depiction of a refrigerator cabinet insulator filling system, according to one embodiment.
Figure 14B:
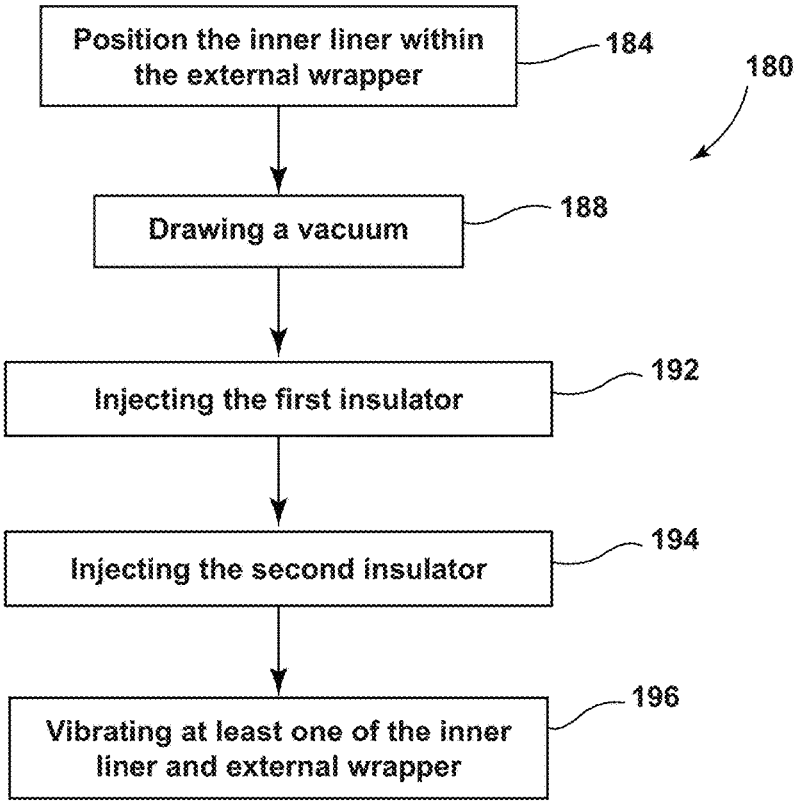
FIG. 14B is a flow chart of a refrigerator cabinet insulator filling method, according to one embodiment.

Referring now to FIGS. 14A and 14B, one embodiment of a first method 180 of inserting the first and second insulators 130, 134 within the gap 126 is depicted. The first method 180 includes step 184, step 188, step 192, step 194 and step 196. In step 184, the inner liner 118 is positioned within the external wrapper 122 as explained in greater detail above. The liner flange 146 and the wrapper flange 162 may be bonded so as to make the gap 126 airtight. Next, step 188 of drawing a vacuum may be performed. A vacuum, or negative pressure relative to atmospheric pressure, is generated within the gap 126. The vacuum is created by drawing the air out of the gap 126 through the at least one vacuum port 170. A pump or other suitable vacuum sources may be connected to the vacuum port 170 to facilitate drawing the vacuum. Additionally or alternatively, the first method 180, or any of its steps, may be performed within a vacuum chamber 198 to provide the vacuum to the gap 126.

Next, step 192 of injecting the first insulator 130 into the gap 126 is performed. Injection of the first insulator 130 into the gap 126 may be accomplished by feeding the first insulator 130 into a hopper 200 which in turn supplies the first insulator 130 to a transfer mechanism 204. The transfer mechanism 204 may be a powder pump, a vacuum transfer device, pneumatic pump, flexible screw conveyor, auger feeder and/or other devices capable of transferring or moving the first and second insulators 130, 134. The transfer mechanism 204 pumps or otherwise injects the first insulator 130 into the gap 126 of the cabinet 114 (FIG. 12A). The transfer mechanism 204 may utilize fluidization of the first insulator 130 to move the first insulator 130 into the gap 126. The transfer mechanism 204 may dispense the first insulator 130 into the cabinet 114 with or without pressure. Use of the transfer mechanism 204 allows the first insulator 130 to be inserted into the gap 126 without any densification or compaction, while also providing an easy and efficient means of inserting the first insulator 130. Once the first insulator 130 has sufficiently filled the front flange area 164 of the cabinet 114 and optionally been leveled off, the filter 174 may be placed on top of the first insulator 130 and optionally coupled to the inner liner 118 and external wrapper 122. Next, step 194 of injecting the second insulator 134 is performed. Injection of the second insulator 134 may be performed in substantially the same manner as injection of the first insulator 130 is carried out in step 192. In other embodiments, the second insulator 134 may be dispensed or injected under different conditions that produce a different packing factor or density of the second insulator 134 relative to the first insulator 130.

Next, step 196 of vibrating at least one of the inner liner 118 and the external wrapper 122 is performed. Vibration of the inner liner 118 and/or the external wrapper 122 may cause the first insulator 130 to increase its packing factor. During steps 184, 188, 192, 194 and/or 196 the inner liner 118 and/or external wrapper 122 may be supported by one or more supports 206 such that relative motion between the inner liner 118 and the external wrapper 122 is minimized or prevented. The supports 206 may allow the thickness of the gap 126 to remain constant through filling and vibration. It will be understood that although method 180 was described in a specific order, the steps may be performed in any order or simultaneously without departing from the spirit of this disclosure.

Figure 15A:
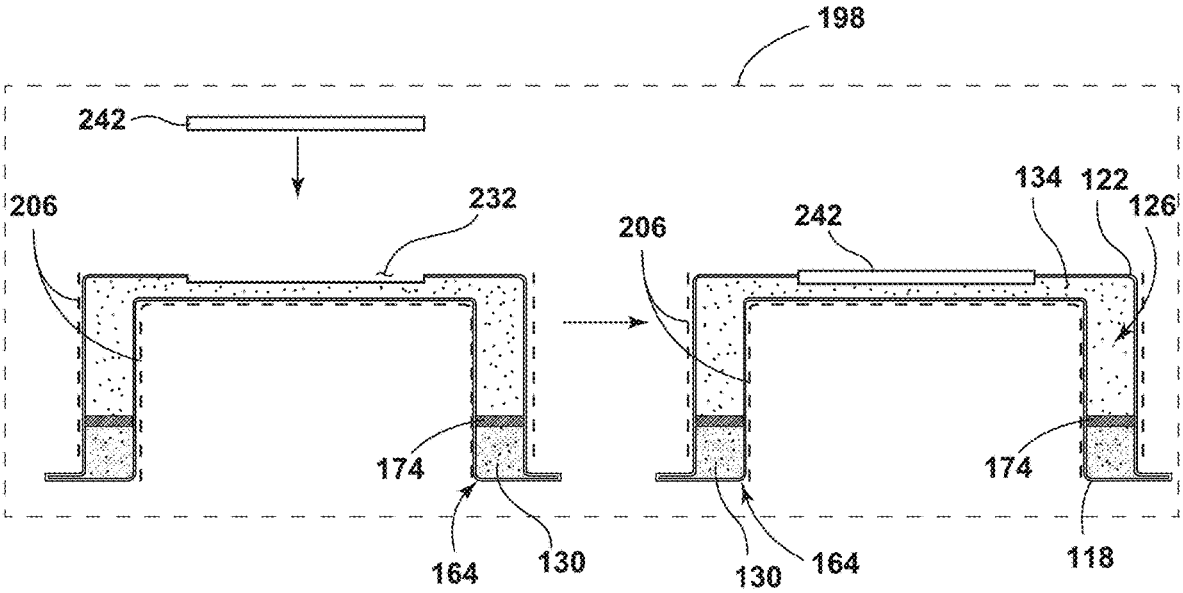
FIG. 15A is a schematic depiction of a refrigerator cabinet insulator filling system, according to one embodiment.
Figure 15B:
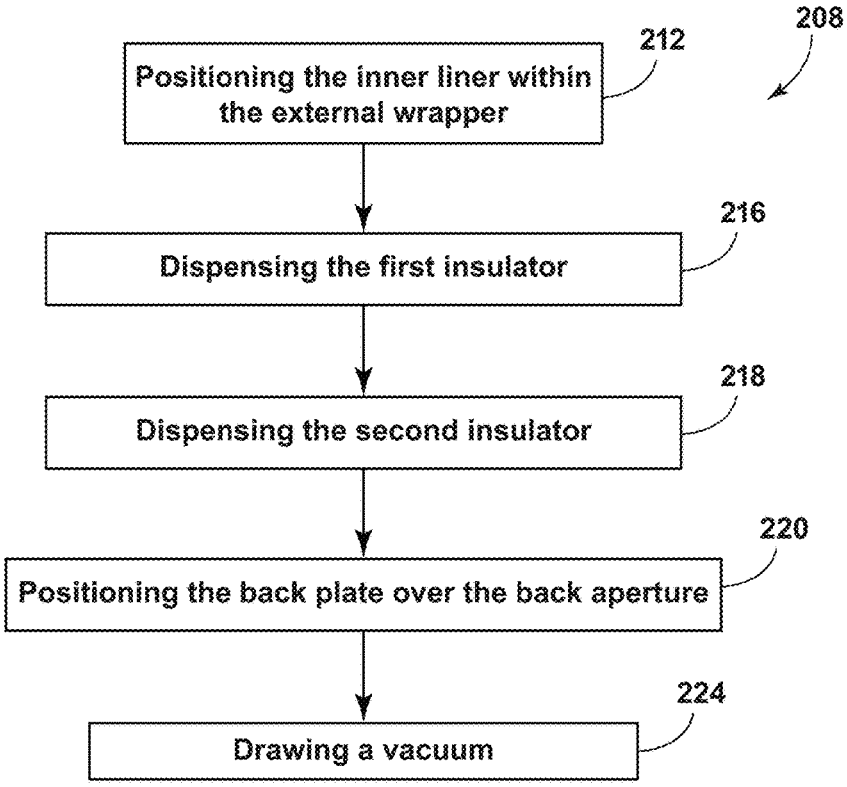
FIG. 15B is a flow chart of a refrigerator cabinet insulator filling method, according to one embodiment.

Referring now to FIGS. 15A and 15B, depicted is a second method 208 of dispensing the insulator 130 within the gap 126 between the inner liner 118 and the external wrapper 122. The second method 208 includes step 212, step 216, step 218, step 220 and step 224. The second method 208 begins with step 212 of positioning the inner liner 118 within the external wrapper 122 and sealing the gap 126, as disclosed above. Next step 216 of dispensing the first insulator 130 within the gap 126 is performed. In the second method 208, dispensing of the first insulator 130 into the gap 126 may be accomplished through a back aperture 232. The back aperture 232 may take a variety of shapes (e.g., square, rectangular, circular, oblong, and combinations thereof) and sizes which are configured to allow the first insulator 130 to be poured or otherwise dispensed into the gap 126. The first insulator 130 may be dispensed into the gap 126 between the inner liner 118 and the external wrapper 122 via the transfer mechanism 204 (FIG. 14A), pouring the first insulator 130, or manual application. In embodiments of the cabinet 114 (FIG. 12A) where the external wrapper 122 includes the back aperture 232, the external wrapper 122 may not include the injection port 166 (FIG. 14A). Optionally, step 216 may be performed while at least one of the inner liner 118 and the external wrapper 122 are vibrated. Vibration of the inner liner 118 and/or the external wrapper 122 may facilitate in shaking or vibrating the first insulator 130 into its maximum packing factor and facilitate a more complete filling of the gap 126. Optionally, once the front flange area 164 is sufficiently filled with the first insulator 130 and optionally the first insulator 130 has been leveled off, the filter 174 may be placed on the first insulator 130 as described above.

Once the front flange area 164 of the gap 126 between the inner liner 118 and the external wrapper 122 is filled with the first insulator 130 and sufficiently packed with the first insulator 130, step 218 of dispensing the second insulator 134 is performed. Dispensing of the second insulator 134 may be accomplished in a substantially similar manner to that described in connection with the first insulator 130 in step 216. Next, step 220 of positioning a back plate 242 over the back aperture 232 is performed. The back plate 242 may be constructed of the same or similar material as the external wrapper 122, or a different material. Once the back plate 242 is positioned over the back aperture 232, the back plate 242 is sealed to the external wrapper 122 to form an airtight, or hermetic, seal. After step 220 is completed, step 224 of drawing a vacuum within the gap 126 is performed. The vacuum may be drawn through the vacuum port 170 (FIG. 14A) of the external wrapper 122. Additionally or alternatively, method 208, or individual steps thereof, may be performed within the vacuum chamber 198 such that drawing a vacuum may not be necessary, or less vacuum can be drawn. Further, the second method 208 may utilize the supports 106 to resist relative motion of the inner liner 118 and the external wrapper 122. It will be understood that steps of the first and second methods 180, 208 may be omitted, combined, mixed and matched, or otherwise reordered without departing from the spirit of this disclosure.

Use of the present disclosure may offer several advantages. For example, use of the present disclosure allows for the formation of vacuum insulated cabinets 114, panels, and structures without noticeable deformation of the inner liner 118 and the external wrapper 122. By filling the gap 126, deformation of the inner liner 118 and the external wrapper 122 from the pressure differential between the atmosphere and the gap 126 is resisted by the first and second insulators 130, 134. Vacuum insulated cabinets 114, panels and structures may provide enhanced insulative properties as compared to traditional foam filled insulating structures in addition to a reduced size (e.g., thickness decrease of greater than about 55%, 60% or 70%). Additionally, use of the disclosure may allow for the construction of a less dense cabinet 114 while also providing increased rigidity due to the use of the first and second insulators 130, 134. Further strategic use of the first insulator 130 in more critical insulation areas (e.g., in the front flange area 164, in corners and/or thin locations) and the second insulator 134 in the rest of the cabinet 114 may allow for a cost savings in embodiments where the first insulator 130 is more expensive (e.g., fumed silica) than the second insulator 134 (e.g., precipitated silica). Even further, in embodiments where the first insulator 130 has a lower increase in thermal conductivity per unit pressure increase than the second insulator 134, use of the first insulator 130 proximate the front flange area 164 allows for a greater resistance to thermal bridging as the pressure within the gap 126 increases over the service life of the refrigerator 110. It will be understood that although the disclosure was described in terms of a refrigerator, the disclosure may equally be applied to coolers, ovens, dishwashers, laundry applications, water heaters, household insulation systems, ductwork, piping insulation, acoustical insulation and other thermal and acoustical insulation applications.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator comprising:

a wrapper, wherein the wrapper includes a wall portion and a front edge with a transverse portion disposed adjacent to the front edge of the wrapper, and further wherein the transverse portion of the wrapper is an angled portion extending inwardly towards a liner, and further wherein the wrapper includes a flange portion disposed between the transverse portion of the wrapper and the front edge of the wrapper, wherein the flange portion of the wrapper extends from the transverse portion of the wrapper in a direction substantially parallel to the wall portion of the wrapper;

wherein the liner is spaced-apart from the wrapper to define a vacuum insulated cavity therebetween, wherein the liner includes a wall portion and a flange portion having a front edge and a transverse portion disposed adjacent to the flange portion of the liner, and further wherein the transverse portion of the liner is an angled portion extending outwardly towards the wrapper, and further wherein flange portion of the liner extends outwardly in a forward direction and is substantially parallel to the wall portion of the liner; and a thermal bridge having a sealing surface and first and second channels, wherein a portion of the wrapper is received in the first channel, and further wherein the front edge of the liner is received in the second channel, and further wherein the first channel is inset from the sealing surface a first distance and the second channel is inset from the sealing surface a second distance that is greater than the first distance.

2. The refrigerator of claim 1, including:

an adhesive disposed within the second channel to adhere the flange portion to the thermal bridge in an airtight manner for retaining a vacuum in the vacuum insulated cavity.

3. The refrigerator of claim 1, including:

an adhesive disposed within the first channel to adhere the flange portion of the wrapper to the thermal bridge in an airtight manner for retaining a vacuum in the vacuum insulated cavity.

4. The refrigerator of claim 1, wherein the wrapper and the liner are comprised of a sheet metal material.

5. The refrigerator of claim 4, wherein the thermal bridge is comprised of a material having a lower coefficient of thermal conductivity as compared to the sheet metal material of the wrapper and the liner.

6. A refrigerator, comprising:

an external wrapper having a wall portion and a front edge with a transverse portion disposed adjacent to the front edge of the external wrapper, and further wherein the transverse portion of the external wrapper is an angled portion extending inwardly towards a liner, and further wherein the external wrapper includes a flange portion disposed between the transverse portion of the external wrapper and the front edge of the external wrapper, wherein the flange portion of the external wrapper extends from the transverse portion of the external wrapper in a direction substantially parallel to the wall portion of the external wrapper;

wherein the inner liner includes at least one wall and an end flange portion having a front edge outwardly offset from the at least one wall by an angled portion extending towards the wrapper, wherein the end flange portion extends outwardly in a forward direction and is substantially parallel to the wall portion of the inner liner, and further wherein the inner liner is disposed inside the external wrapper; and a trim breaker having a sealing surface, wherein the trim breaker interconnects the external wrapper and the inner liner, such that the external wrapper is spaced-apart from the inner liner to define a gap therebetween, wherein the trim breaker includes a wrapper joint in which the front edge of the external wrapper is received, and further wherein the trim breaker includes a liner joint in which the front edge of the inner liner is received, and further wherein the wrapper joint is inset from the sealing surface a first distance and the liner joint is inset from the sealing surface a second distance that is greater than the first distance.

7. The refrigerator of claim 6, wherein the angled portion of the external wrapper is angled towards the gap disposed between the external wrapper and the inner liner.

* * * * *